US007118048B2

(12) United States Patent
Williams et al.

(10) Patent No.: US 7,118,048 B2
(45) **Date of Patent: *Oct. 10, 2006**

(54) APPARATUS AND METHOD FOR DROPLET STEERING

(75) Inventors: Roger O. Williams, Paradise Valley, AZ (US); Michael R. Van Tuyl, San Jose, CA (US); Michael J. Forbush, Hollister, CA (US)

(73) Assignee: EDC Biosystems, Inc., Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/231,579

(22) Filed: Sep. 21, 2005

(65) Prior Publication Data

US 2006/0011744 A1 Jan. 19, 2006

Related U.S. Application Data

(63) Continuation of application No. 10/006,489, filed on Dec. 6, 2001, now Pat. No. 6,976,639.

(60) Provisional application No. 60/348,429, filed on Oct. 29, 2001.

(51) Int. Cl.
*B05B 1/28* (2006.01)

(52) U.S. Cl. ..... 239/290

(58) Field of Classification Search ..... 239/290, 239/398, 406, 418, 419.5, 424, 425.5, 434
See application file for complete search history.

(56) References Cited

U.S. PATENT DOCUMENTS 3,864,692 A * 2/1975 McDonnell et al. ..... 347/77
4,097,872 A * 6/1978 Giordano et al. ..... 347/21
4,375,062 A * 2/1983 Sturm ..... 347/21
4,740,571 A * 4/1988 Nagano et al. ..... 526/201
5,621,443 A * 4/1997 Buschulte et al. ..... 347/73
5,716,540 A * 2/1998 Matiacio et al. ..... 249/117
5,722,479 A * 3/1998 Oeftering ..... 164/46
5,759,961 A * 6/1998 Zeigler et al. ..... 65/507
6,360,973 B1 * 3/2002 Stilli ..... 239/590
6,586,731 B1 * 7/2003 Jolliffe ..... 250/288

* cited by examiner

*Primary Examiner*—Mohammad M. Ali
(74) *Attorney, Agent, or Firm*—Donald J. Pagel

(57) ABSTRACT

An apparatus and method for droplet steering is disclosed herein. A throated structure having a nozzle defines a converging throat with an inlet and an outlet and a vectored fluid stream directed therethrough. The fluid stream is driven through the system via a vacuum pump. As the fluid approaches the outlet, its velocity increases and is drawn away from the nozzle through a connecting channel. As a droplet is ejected from a liquid therebelow, it will have a first trajectory until it is introduced to the high velocity fluid stream at the perimeter of the interior walls of the nozzle. The fluid accordingly steers the momentum of the droplet such that it obtains a second or corrected trajectory. Alternative variations include an electrically chargeable member, e.g., a pin, positionable to be in apposition to the outlet and capillary tubes for controlling the ejection surface of the pool of source fluid.

20 Claims, 19 Drawing Sheets

APPARATUS AND METHOD FOR DROPLET STEERING

CROSS-REFERENCE TO RELATED APPLICATIONS

This application is a continuation of U.S. application Ser. No. 10/006,489, filed on Dec. 6, 2001, now U.S. Pat. No. 6,976,639, which is incorporated herein by reference in its entirety, and which claimed the benefit of priority of U.S. Provisional Patent Application No. 60/348,429, filed Oct. 29, 2001.

TECHNICAL FIELD OF THE INVENTION

The invention relates generally to the control of a trajectory of a fluid moving in free space. More particularly, the invention relates to apparatus and methods of trajectory correction of liquid droplets moving through free space via directed fluid flows and electrostatic devices.

BACKGROUND OF THE INVENTION

Various technologies have been developed utilizing techniques in which fluids are ejected from a reservoir by focused acoustic energy. An example of such technology is typically referred to as acoustic ink deposition which uses focused acoustic energy to eject droplets of a fluid, such as ink, from the free surface of that fluid onto a receiving medium.

Generally, when an acoustic beam impinges on a free surface, e.g., liquid/air interface, of a pool of liquid from beneath, the radiation pressure will cause disturbances on the surface of the liquid. When the radiation pressure reaches a sufficiently high level that overcomes the surface tension of the liquid, individual droplets of liquid may be ejected from the surface.

However, many different factors may arise which can interfere with the droplet ejection and resulting droplet trajectory. For instance, care must be taken to accurately direct the acoustic beam to impinge as exclusively as possible on the desired lens which focuses the acoustic beam energy. Some undesirable effects of the acoustic beam impinging other than on the desired lens include insufficient radiation pressure on the liquid surface, lens cross-talk, and generation of undesirable liquid surface disturbances. Each of these effects may result in the loss or degradation of droplet ejection control.

A further problem related to liquid surface disturbances include surface waves affecting the surface planarity. These waves result in deviations of the free surface from planar and alter the location of the surface relative to the focal point of the lens, thereby resulting in degradation of droplet ejection control. The result of this is a varying angle of droplet ejection.

Droplets will tend to eject in a direction normal to the liquid surface. For optimum control of placement of the droplet onto an opposing target medium, conventional methods have included maintaining ejection angles of the droplets at a predetermined value, generally perpendicular to the local angle of the surface of the opposing target medium. Accordingly, attempts have been made to maintain a liquid surface parallel to the target medium. Surface disturbances will vary the local surface angle of the liquid pool, especially over the acoustic lenses. This typically results in drop ejection at varying ejection angles with a consequent loss of deposition alignment accuracy and efficiency.

Other conventional methods have included increasing the energy required to cause the droplet ejection to account for varying droplet ejection angles; however, this may have adverse effects on droplet size, droplet count, and droplet ejection direction control.

Another conventional method includes varying the transducer size such that illumination outside the lens is minimized. A further method has included increasing the radius of the acoustic lens itself such that the diverging acoustic waves impinge fully on the lens. However, this generally increases the size and cost of the system and is not necessarily efficient in controlling the droplet ejection angles.

Small volumetric liquid droplets moving individually through free space over distances greater than about 100 times their diameter typically have problems repeating the same trajectory and positional orientation. Accordingly, there remains a need for an efficient device and method for effectively controlling, steering, or correcting the trajectories of droplets ejected from a liquid surface such that they are accurately placed on a targeting medium.

SUMMARY OF THE INVENTION

An apparatus and method for steering droplets, i.e., correcting or altering the trajectory of droplets moving through free space, by utilizing directed fluid flow is disclosed herein. Generally, a throated structure preferably comprising a nozzle defining a throat may have an inlet or entrance port and a preferably smaller outlet or exit port. A venturi structure may also be used in which case the inlet or entrance port may open into a nozzle which converges to a narrower throat and reopens or diverges into a larger outlet or exit port. Use of a venturi structure, however, may result in longer flight times for the ejected droplets prior to reaching the targeting medium.

In the case of a nozzle defining a throat having an inlet or entrance port and a smaller outlet or exit port, the throat preferably converges from a larger diameter inlet to a smaller diameter outlet. Through this throat, a vectored or directed fluid stream may be directed into the inlet to be drawn through the structure. The fluid stream is preferably driven through the system via a pump, either a positive or negative displacement pump, such as a vacuum pump. As the fluid stream approaches the outlet, the fluid may increase in velocity and is preferably drawn away from the centerline of the nozzle through a connecting deviated fluid flow channel. The fluid stream may be drawn away from the throat at a right angle from the centerline of the nozzle or at an acute angle relative to the nozzle centerline. The fluid stream may then continue to be drawn away from the throat and either vented or recycled through or near the inlet again. The fluid used, e.g., air, nitrogen, etc., may comprise any number of preferably inert gases, i.e., gases which will not react with the droplet or with the liquid from which the droplet is ejected. However, a fluid that is highly reactive with the ejected liquid droplet may also be used. This reactive fluid may be comprised of several compounds or a single fluid.

A droplet ejected from the surface of a liquid will typically have a first trajectory or path. The liquid is preferably contained in a well or reservoir disposed below the nozzle. If the trajectory angle of the droplet relative to a centerline of the inlet nozzle is relatively small, i.e., less than a few tenths of a degree off normal, the droplet may pass through the outlet and on towards a target with an acceptable degree of accuracy. If the trajectory angle of the droplet is relatively large, i.e., greater than a few degrees and up to about ±22.5°, the droplet may be considered as being off target.

As the droplet enters the inlet off-angle and as it advances further up into the structure, the droplet is introduced to the high velocity fluid stream at the perimeter of the interior walls of the nozzle. The fluid stream accordingly steers or redirects the momentum of the droplet such that it obtains a second or corrected trajectory which is closer to about 0° off-axis. The fluid stream at the connecting deviated fluid flow channel is preferably drawn away from the centerline of the nozzle and although the droplet may be subjected to the fluid flow from the connecting deviated fluid flow channel, the droplet has mass and velocity properties that constrain its ability to turn at right or acute angles when traveling at a velocity, thus the droplet is allowed to emerge cleanly from the outlet with high positional accuracy. Throated structure may correct for droplet angles of up to about ±22.5°, but more accurate trajectory or correction results may be obtained when the droplet angles are between about 0°–15° off-axis.

To facilitate efficient fluid flow through the throated structure, the throat is preferably surrounded by a wall having a cross-sectional elliptical shape. That is, the cross-sectional profile of the wall taken in a plane that is parallel to or includes the axis of the nozzle preferably follows a partial elliptical shape. The exit channels which draw the fluid away from the centerline of the throat may also have elliptically shaped paths to help maintain smooth laminar flow throughout the structure. It also helps to bring the fluid flow parallel to the centerline as well as maintaining a smooth transition for the exit flow as well as maintaining an equal exit flow on the throat diameter. This in turn may help to efficiently and effectively eject droplets through the structure.

In addition to the throated structure, alternative variations of the device may include a variety of additional methods and/or components to aid in the fluid flow or droplet steering. For instance, the nozzle may be mounted or attached to a platform which is translatable in a plane independent from the wellplate over which the nozzle is located. As the wellplate translates from well to well and settles into position, the nozzle may be independently translated such that as the wellplate settles into position, the nozzle tracks the position of a well from which droplets are to be ejected and aligns itself accordingly. The nozzle may be tracked against the wellplate and aligned by use of a tracking system such as an optical system, e.g., a video camera, which may track the wells by a tracking algorithm on a computer.

Additionally, an electrically chargeable member, e.g., a pin, may be positioned in apposition to the outlet to polarize the droplets during their travel towards the target. Polarizing the droplets helps to influence the droplet trajectory as the droplets are drawn towards the chargeable member for more accurate droplet deposition. Additionally, well inserts for controlling the ejection surface of the pool of source fluid from which the droplets are ejected may also be used in conjunction with the throated structure. Furthermore, various manifold devices may be used to efficiently channel the fluid through the system.

Aside from manifold devices, a variation using a separately attachable lid assembly may also be used. The lid assembly may be placed over a conventional wellplate and may define any number of nozzles or throats within the plate, the number of nozzles preferably corresponding to the number of wells within the wellplate. Rather than utilizing a single nozzle or throat for the entire wellplate, each well may have its own dedicated nozzle which may be individually placed in fluid communication with a fluid source assembly positioned over the lid assembly. The fluid stream may be drawn into the assembly through a number of fluid stream inlets coming into fluid communication through a common plenum with each of the nozzles.

A capillary well mask may also be used with the lid assembly. Such a well mask would preferably have a number of capillary tubes formed on the mask and each tube would be capable of being inserted individually within a number of corresponding wells within the wellplate. After the capillary tubes are placed within the corresponding wells, the liquid contained within the wells may tend to be pulled into their respective tubes and drawn up through the tube orifice by capillary action. The liquid may then rise to a level within a tube which is constant relative to the liquid levels in other tubes. Because each well could have its own individual capillary tube, the focal point across each of the wells may be constant such that a droplet generator would not need to focus and refocus its energy for ejecting droplets for different wells having different liquid levels without such a capillary tube.

Another variation may include using a well mask having a variable orifice diameter defined therein for use either with a single throated structure design, or using a well mask with multiple orifices for use with a lid assembly having multiple throats defined therein and placed over a wellplate. Such a well mask may be used particularly with wellplates having relatively large diameter wells, i.e., wells with diameters measuring 4.5 mm or greater, to emulate a smaller diameter well to aid in fluid flow efficiency.

DETAILED DESCRIPTION OF THE INVENTION

Figure 1:
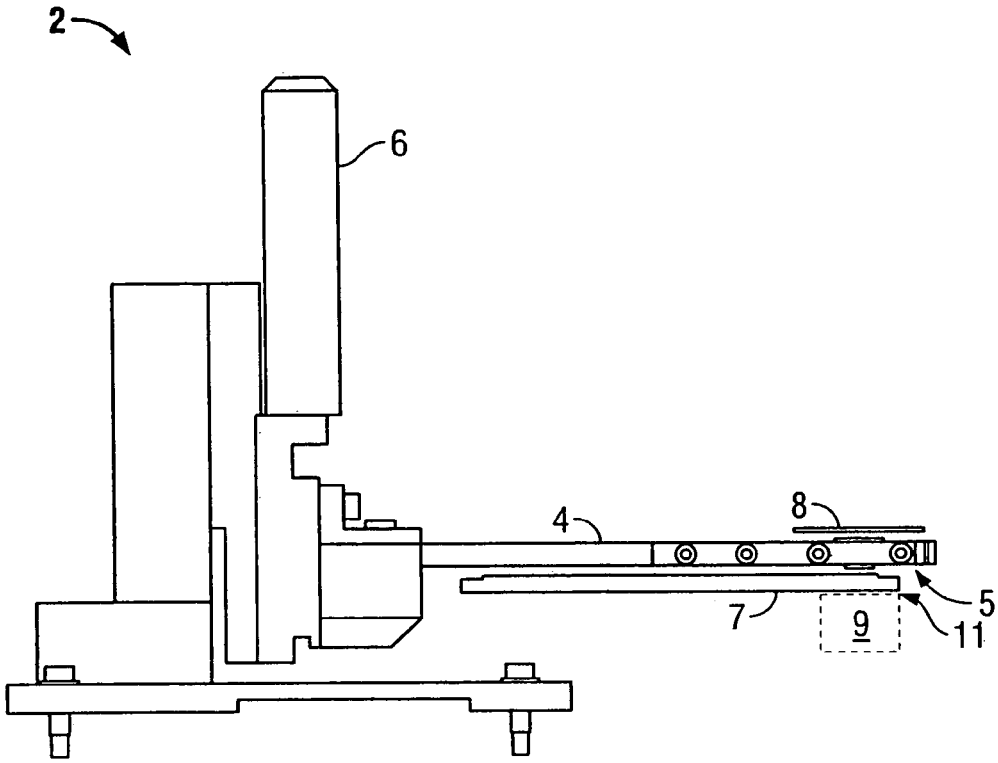
FIG. 1 shows a representative schematic diagram of a non-contact fluid transfer system in which a droplet steering assembly may be used.

An apparatus and method for droplet steering, i.e., correcting or altering the trajectory of a droplet moving through free space, by utilizing directed fluid flow, e.g., gas flow, is disclosed herein. A representative schematic diagram of a non-contact fluid transfer system 2 is shown in FIG. 1. As seen, support arm 4 extends from a platform which may be manipulated via, e.g., z-axis adjustment assembly 6, over wellplate 7. Weliplate 7 may contain a single well or reservoir or it may contain numerous wells. Wellplate 7 may be a microwell in a conventional microtiter plate, which are made with a number of wells, e.g., 24, 96, 384, 1536, 3456, 6912, or any number combination source of wells. A droplet steering assembly 5, which operates according to the principles disclosed herein, is preferably located near the end of support arm 4 and over droplet generator 9. Steering assembly 5 is also preferably disposed beneath or adjacent to a targeting medium 8. As applied throughout, any number of structures may be movable along their x-, y-, or z-axis relative to one another, e.g., droplet steering assembly 5, wellplate 7, target 8, or droplet generator 9 may all be separately movable relative to one another or only certain structures may be movable depending upon the desired application. A detailed description of a non-contact fluid transfer system with which the steering assembly 5 may be used is disclosed in co-pending U.S. patent application Ser. No. 09/735,709 entitled "Acoustically Mediated Fluid Transfer Methods And Uses Thereof" filed Dec. 12, 2000, now U.S. Pat. No. 6,596,239, which is incorporated herein by reference in its entirety.

Figure 2:
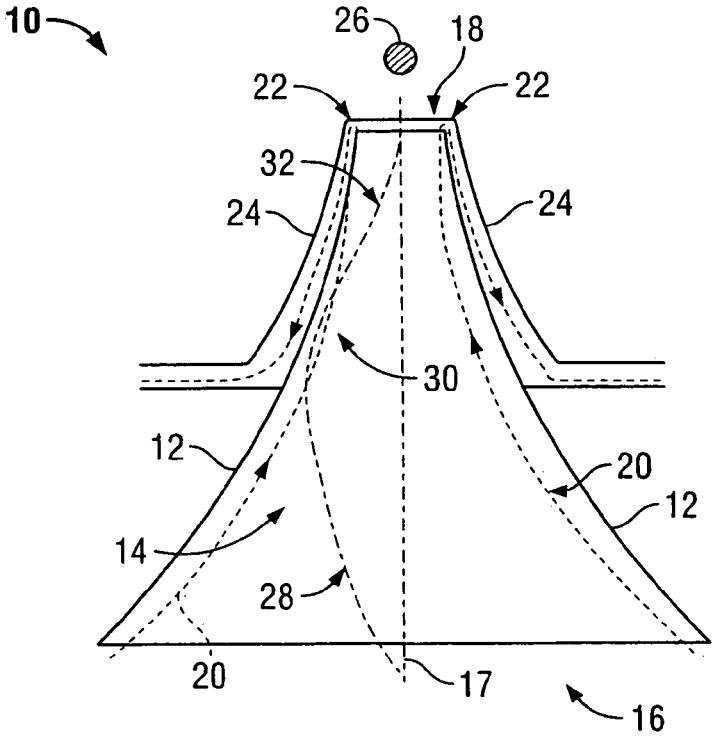
FIG. 2 shows a representative schematic diagram of a throated structure which illustrates, in part, the general operation of the droplet steering apparatus.

FIG. 2 shows a representative schematic of throated structure 10 which illustrates, in part, the general operation of the droplet steering apparatus. Generally, throated structure 10 may comprise a nozzle 12 which defines throat 14. Nozzle 12 is preferably a converging nozzle, as described in greater detail below, having an inlet or entrance port 16 and a preferably smaller outlet or exit port 18. A vectored or directed fluid stream, as shown by flow lines 20, may be directed into inlet 16 to be drawn through the structure 10. As nozzle 12 converges in diameter closer to outlet 18, fluid stream 20 may increase in velocity and as stream 20 approaches outlet 18, it is preferably drawn away from the centerline 17 of nozzle 12 through deviated fluid flow channel 22. Fluid stream 20 may be drawn away from throat 14 at a right angle from the centerline 17 of nozzle 12 or at an acute angle, as currently shown. Fluid stream 20 may then continue to be drawn away from throat 14 through outlet 24 either for venting or recycling through inlet 16 again. Fluid stream 20 may comprise any number of fluids which are preferably inert, e.g., air, nitrogen, etc. However, a reactive micro-droplet mist stream with a combined fluid mixture containing micro-droplets may also be used as fluid stream 20. These micro-droplets in the mist stream are preferably about 100 times smaller than ejected droplet 26 and may have specific properties that cause specified reactions to ejected droplet 26.

As droplet 26 is ejected from the surface of liquid, it will have a first trajectory or path 28. The volume of the droplets are preferably less than or equal to about 15,000 picoliters ($10^{-12}$ liters) and droplet 26 diameters preferably range from about 5–300 microns. Also, droplet 26 densities preferably range from about 0.5–2.0 grams/milliliter. If the trajectory angle of droplet 26 relative to a centerline 17 of nozzle 12 is relatively small, i.e., less than a few degrees off normal, droplet 26 may pass through outlet 18 and on towards target 8 with some degree of accuracy. If the trajectory angle of droplet 26 is relatively large, i.e., up to about ±22.5°, droplet 26 may be considered as being off target. However, with fluid stream 20 flowing through structure 10, a droplet 26 may be ejected from a well located below structure 10. As droplet 26 enters inlet 16 off target and as it advances further up into structure 10, droplet 26 is introduced to the high velocity fluid stream 20 at the perimeter of the interior walls of nozzle 12, as seen at the point of capture 30. Fluid stream 20 accordingly steers or redirects the momentum of droplet 26 such that it obtains a second or corrected trajectory 32 which is closer to about 0° off-axis. The fluid stream 20 at deviated channel 22 is drawn away from the centerline 17 of nozzle 12 and although droplet 26 may be subjected to the deviated vector of fluid flow 20, droplet 26 has mass and velocity properties that constrain its ability to turn at right or acute angles while traveling at some velocity, thus droplet 26 is allowed to emerge cleanly from outlet 18 with high positional accuracy. Throated structure 10 may correct for droplet 26 angles of up to about ±22.5°, but more accurate trajectory or correction results may be obtained when droplet 26 angles are between about 0°–15° off-axis for the given velocity, droplet size, and mass present in the current system. For example, a given droplet 26 of water having a velocity of about 1–10 m/s, a diameter of about 10–300 microns with a volume of about 0.5–14,000 picoliters, and a mass of about 500 picograms ($500\times10^{-12}$ grams) to 14 micrograms ($14\times10^{-6}$ grams) may have its trajectory correctable within the angles of ±22.5°, but the angles of correction are subject to variations depending upon the mass and velocity properties of the droplet 26.

Figure 3A:
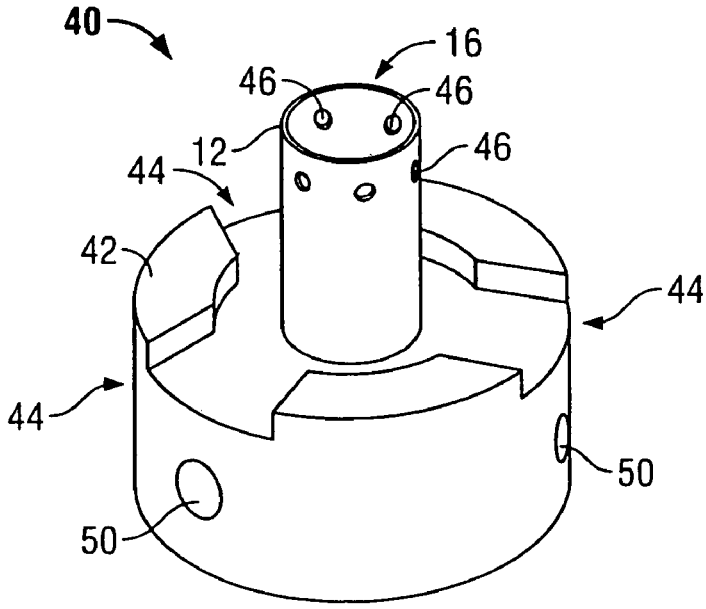
FIGS. 3A to 3C show isometric, reverse isometric, and bottom views, respectively, of a variation on a device for droplet steering.
Figure 3B:
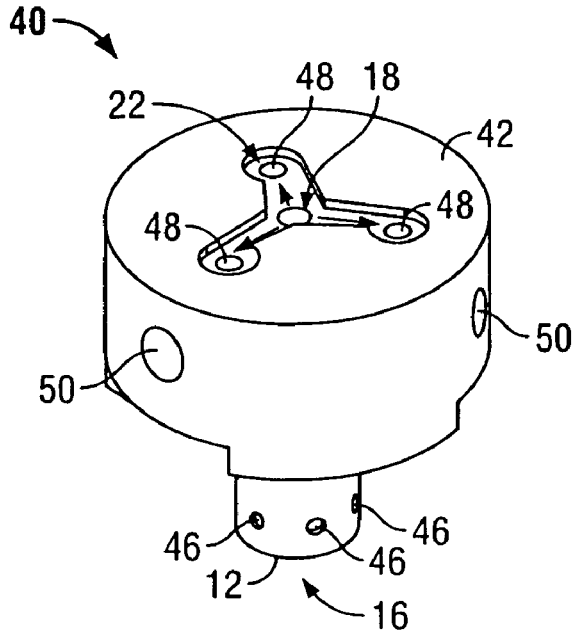
Figure 3C:
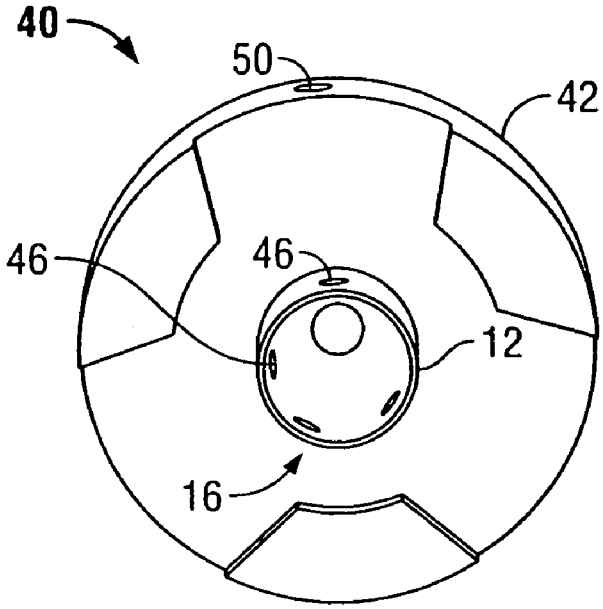

With the general operation of the droplet steering apparatus described, FIGS. 3A–3C show isometric, reverse isometric, and bottom views, respectively, of a variation on a device for droplet steering in main body 40. As seen in this variation, main body 40 is comprised of channeled housing 42 to which nozzle 12 may be attached. At a proximal end of nozzle 12, inlet or entrance port 16 opens into main body 40 and converges to outlet or exit port 18. Near the proximal end of nozzle 12 may be a plurality, i.e., greater than one, of fluid inlet orifices 46 preferably located radially about the end of nozzle 12. Fluid inlets 46 may provide an entrance for the directed fluid stream to enter main body 40. The fluid stream may be routed to enter nozzle 12 directly through inlet 16, but is preferably directed to enter via fluid inlets 46 so that main body 40 may be used in conjunction with other devices, as described in greater detail below, as well as to minimize any potential disturbances to the pool of source fluid from which the droplets are ejected.

On the surface of main body 40 which is opposite to nozzle 12, fluid flow channel 22 is preferably located to allow for the drawing away of the fluid from the centerline 17 of nozzle 12. The fluid that exits outlet 18 and is drawn away via channel 22 may then be routed away from main body 40 through routing outlets 48, which may direct the fluid back through main body 40 and out through fluid outlet 50. This variation shows three routing outlets 48 exiting through their corresponding fluid outlets 50 to evenly distribute the fluid flow, but any number of outlets 48 and 50 that is practicable may be used. To facilitate the fluid stream entering fluid inlets 46, channels 44 may be defined in the surface of main body 40 adjacent to nozzle 12. Channels 44 are preferably passages notched into main body 40 and extend radially from nozzle 12 to give the fluid stream sufficient space to flow above a wellplate when main body 40 is in use. Preferably, the space is also sufficiently large such that the flowing fluid does not disturb the surface of the liquid. Main body 40 may be made from a variety of materials, for instance, moldable thermoset plastics, preferably provided that the plastic is resistant to building up an electrostatic charge, die-cast metals, etc.

Figure 4A:
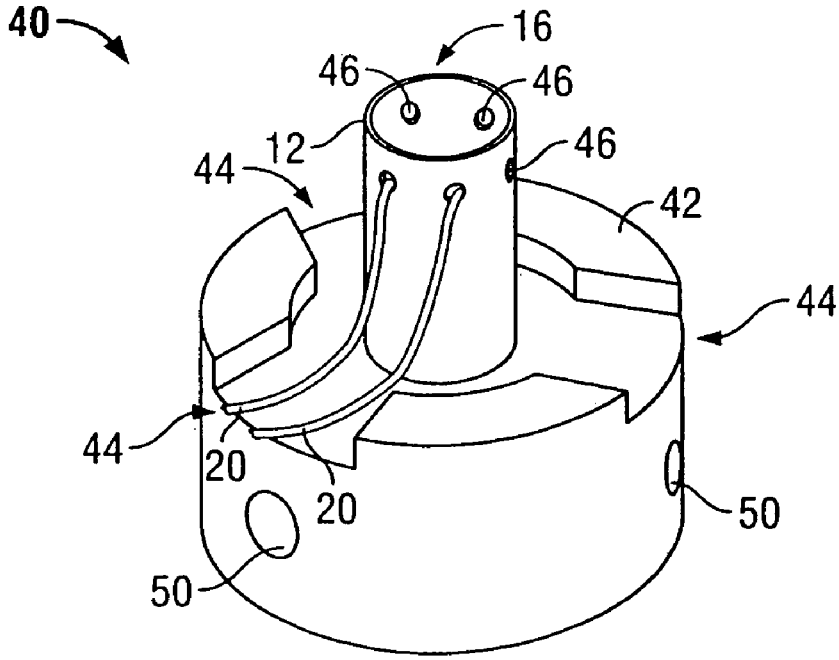
FIGS. 4A and 4B correspond to FIGS. 3A and 3C showing an example of flow lines of a fluid stream flowing over and through the main body.
Figure 4B:
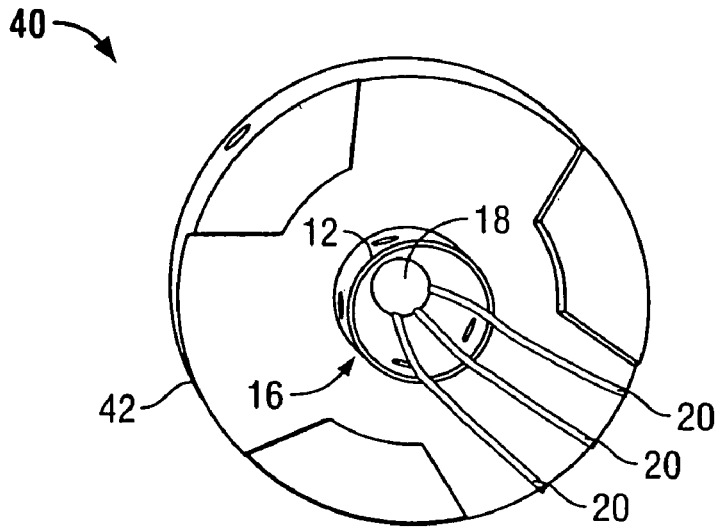

FIGS. 4A and 4B are figures corresponding to FIGS. 3A and 3C and show examples of flow lines or paths 20 that a fluid stream follows when flowing through main body 40. FIG. 4A shows flow lines 20 for the directed fluid stream as it passes through channel 44 and is drawn through fluid inlets 46 located near the proximal end of nozzle 12. FIG. 4B shows flow lines 20 as they are directed up through nozzle 12 and towards outlet 18 where the fluid is then preferably drawn away from the centerline 17 of nozzle 12.

Figure 5:
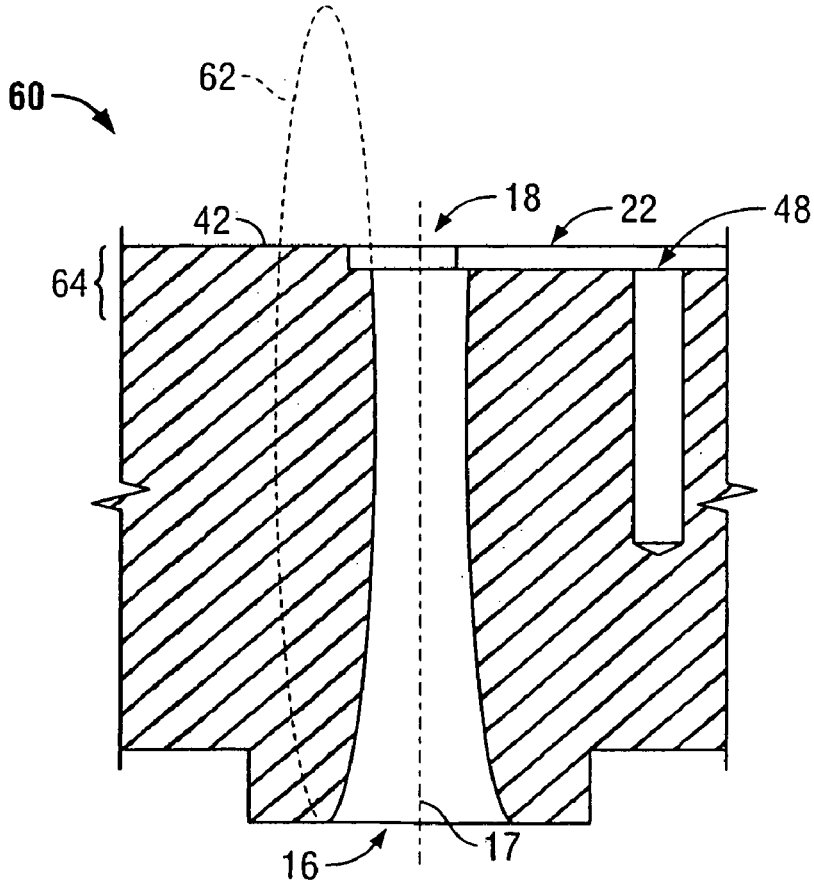
FIG. 5 shows a schematic cross-sectional view of a variation of the throated structure where the wall defining the throat has an elliptical cross-sectional shaped.

FIG. 5 shows a schematic cross-sectional view of a variation of the throated structure 60. The throated structure 60 may define a throat surrounded by a wall having a cross-sectional elliptical shape, as defined by ellipse 62. That is, the cross-sectional profile of the wall taken in a plane that is parallel to or includes the axis of the nozzle preferably follows a partial elliptical shape. Ellipse 62 is shown in this variation as having a minor axis of about 1.0 mm and a major axis of about 10.0 mm. Utilizing elliptically shaped walls helps to maintain a smooth laminar flow through throated structure 60, which in turn helps to maintain a stable flow of fluid. It also helps to bring the fluid flow parallel to centerline 17, which aids in accurate deposition of droplets. The major axis of ellipse 62 is preferably parallel to the centerline 17 of the structure 60 and accordingly, the minor axis of ellipse 62 is perpendicular to the centerline 17. The elliptically-shaped wall presents a preferably converging throat design. Accordingly, inlet 16 may have a diameter ranging from about 1.0–3.0 mm and an outlet 18 having a diameter ranging from about 0.025–1.0 mm. Inlet 16 preferably has a diameter of 2.0 mm and outlet 18 preferably has a diameter of 0.5 mm. The distal end of throated structure 60 may preferably define a section 64 along the structure 60 where the throat diameter is uniformly constant thereby forming a cylindrically uniform section. This section 64 may have a length of about 0.5–1 mm in length and the overall length of structure 60 from inlet 16 to outlet 18 may be about 5.5 mm in length. The dimensions of ellipse 62, and thereby the dimensions of structure 60, may vary depending upon the desired fluid flow characteristics and desired inlet 16 and outlet 18 dimensions. For instance, the length of structure 60 may vary anywhere in length from 1–150 mm but is preferably 6, 12, or 24 mm in length.

Furthermore, structure 60 may have a variety of shaped walls, for instance, it may have simple conically-shaped walls converging from inlet 16 to outlet 18, or it may have non-elliptical curved or arcuate shaped walls. Flow velocities through throated structure 60 may be simply calculated based upon the diameters of inlet 16 and outlet 18. For example, assuming an inlet 16 diameter of 3 mm and an outlet 18 diameter of 1 mm, a fluid having an initial velocity of 1 m/s at inlet 16 will have a velocity of 9 m/s at outlet 18. Aside from flow velocity, flow rate of the fluid through throated structure 60 preferably ranges from about 0.5–5 standard liters per minute with the distance from the wellplate to the proximal end of throated structure 60 about 0.25–8 mm.

Figure 6:
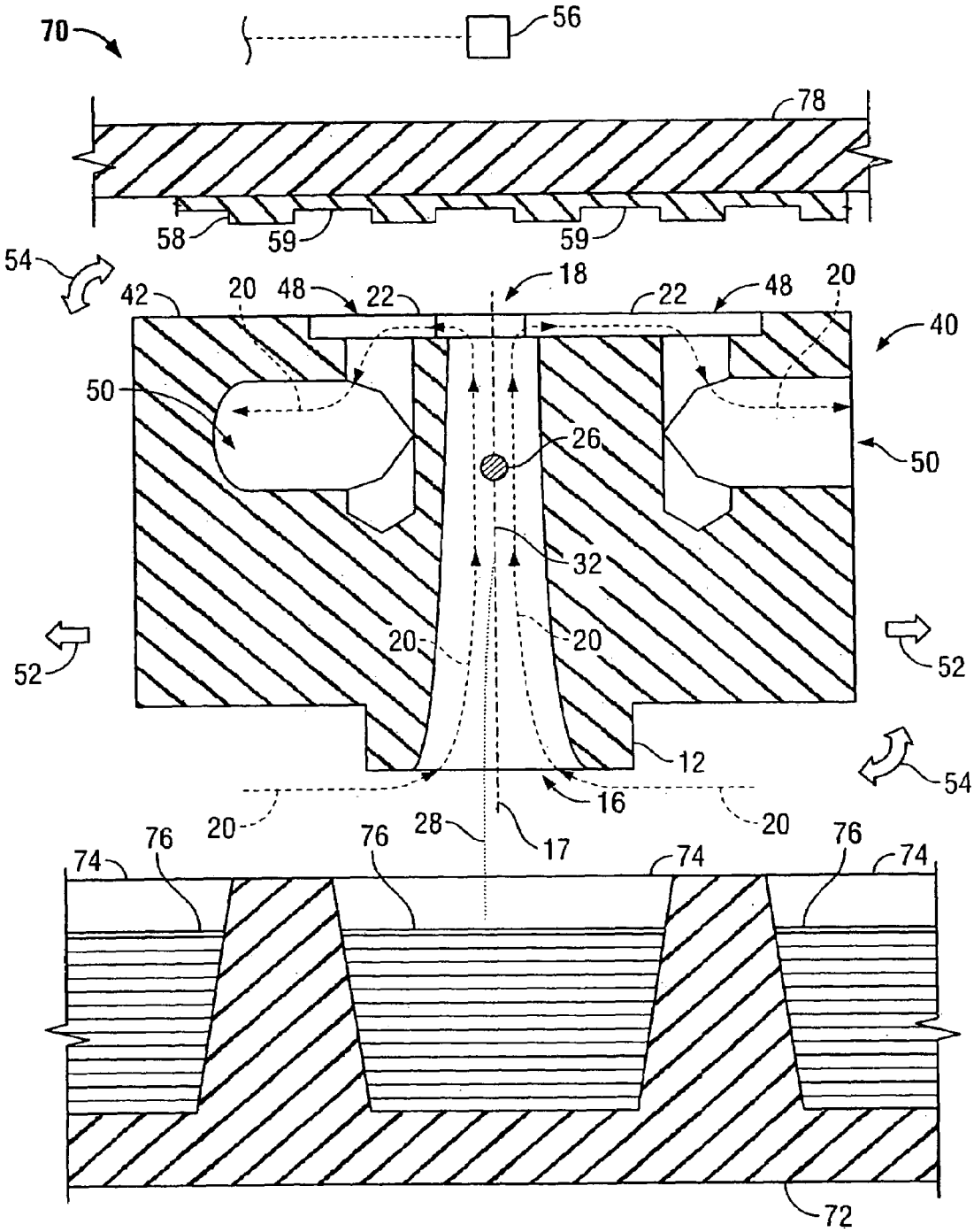
FIG. 6 shows an example of a droplet steering assembly with a wellplate and a target medium.

An example of droplet steering assembly 70 is shown in use in FIG. 6. Main body 40 is preferably located above wellplate 72 which may contain a number of wells 74 each having a pool of source fluid 76, which may or may not be the same fluid contained in each well 74. Target medium 78 preferably comprises a planar medium which is perpendicular to a longitudinal axis defined by the throated structure. Target medium 78 may comprise any medium, e.g., a glass slide, upon which droplets of fluid are desirably disposed and is preferably disposed above main body 40, specifically above outlet 18, for receiving the droplets ejected from source fluid 76.

In operation, droplet 26 is ejected from source fluid 76 by various methods, such as acoustic energy. Once ejected, droplet 26 enters main body 40 through inlet 16 along a first trajectory or path 28. The flow of fluid, as shown by flow lines 20, may be seen in this variation entering main body 40 also through inlet 16, although the fluid may enter through separate fluid inlets defined near the proximal end of nozzle 12 in other variations. As the fluid is directed through main body 40, as shown by flow lines 20, it may inundate droplet 26 and transfer momentum to droplet 26 to alter its flight path to a second or corrected trajectory 32 such that droplet 26 passes through outlet 18 with the desired trajectory towards target 78. Meanwhile, the fluid is preferably diverted away from the centerline 17 of the throat near outlet 18 along fluid flow channel 22, through routing outlet 48, and out through fluid outlet 50. If droplet 26 enters main body 40 with a desirable first trajectory 28, i.e., a trajectory traveling close to or coincident with the centerline 17 of the throated structure, droplet 26 may experience little influence from flow lines 20 and accordingly little correction or steering, if any, may be imparted to droplet 26. The fluid may be pushed through assembly 70 through positive pressure via a pump (pump is not shown) in fluid communication with main body 40 or preferably the fluid may be drawn through the system through negative pressure via a vacuum pump (vacuum pump is not shown) in fluid communication with main body 40 through fluid outlet 50.

The main body 40 may be further mounted or attached to a platform which is translatable in a plane independently from wellplate 72 for use as a fine adjustment mechanism as droplets 26 are ejected from the various source fluids 76 in each of the different wells 74. The translation preferably occurs in the plane which is parallel to the plane of wellplate 72, as shown by the direction of arrows 52 which denote the direction of possible movement. Although arrows 52 denote possible translation to the left and right of FIG. 6, movement may also be possible into and out of the figure. The degree of translation may be limited to a range of at least ±2 mm from a predetermined fixed neutral reference point initially defined by the system. Main body 40 may also be rotatable, as shown by arrows 54, about a point centrally defined within main body 40 such that inlet 16 is angularly disposed relative to the plane defined by wellplate 72.

In operation, wellplate 72 may be translated using, e.g., conventional linear motors and positioning systems, to selectively position individual wells 74 beneath main body 40 and inlet 16. As wellplate 72 is translated from well to well, time is required not only for the translation to occur, but time is also required for the wellplate 72 to settle into position so that well 74 is aligned properly beneath inlet 16. To reduce the translation and settling time, main body 40 may also be independently translated such that as wellplate 72 settles into position, main body 40 tracks the position of a well 74 and aligns itself accordingly. Main body 40 may be aligned by use of a tracking system such as an optical system, e.g., video camera 56, which may be mounted in relation to main body 40 and individual wells 74. Video camera 56 may be electrically connected to a computer (not shown) which may control the movement of the platform holding main body 40 or main body 40 itself to follow the movement of wellplate 72 as it settles into position. Aside from the translation, main body 40 may also rotate independently during the settling time of wellplate 72 to angle inlet 16 such that it faces the preselected well 74 at an optimal position. The fine adjustment processes, i.e., translation either alone or with the rotation of main body 40, may aid in reducing the time for ejecting droplets from multiple wells, and may also aid in improving accuracy of droplets deposited onto target medium 78.

Figure 7:
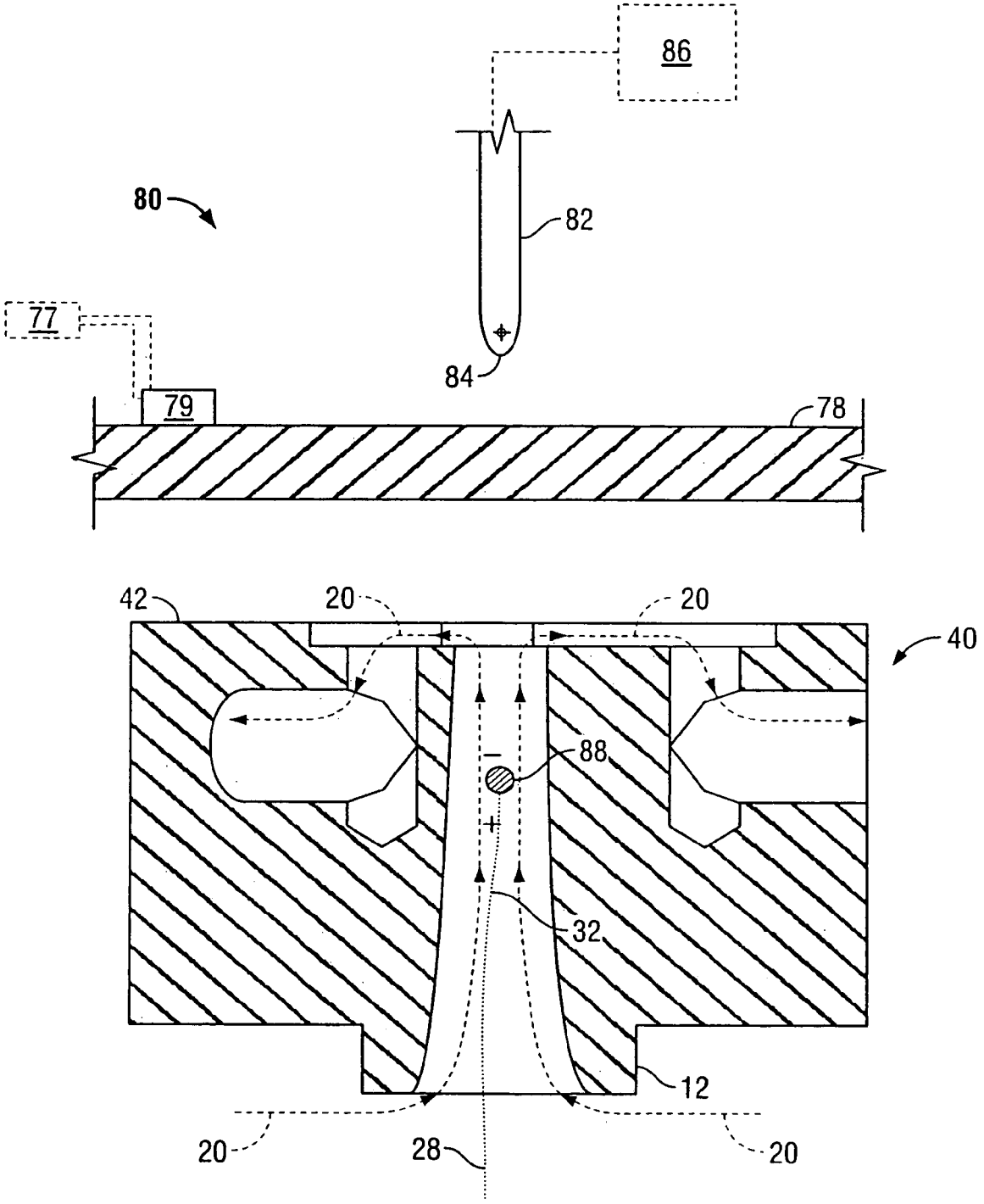
FIG. 7 shows another variation of the droplet steering assembly with an electrically chargeable member positionable above the target medium.

A system such as droplet steering assembly 70 is proficient in altering or correcting a droplet trajectory. It may also be useful for polar liquids such as aqueous solutions or suspensions. To further facilitate the droplet trajectory correction, another variation of droplet steering assembly 80 is shown in FIG. 7, which shows the main body 40 and target medium 78 of FIG. 6 with an additional electrically chargeable member 82. Electrically chargeable member 82 may comprise any electrically chargeable material, such as metal, and is preferably formed in an elongate shape, e.g., such as a pin. Member 82 is preferably electrically connected to voltage generator 86 which may charge member 82 to a range of about 500–40,000 volts but is preferably charged to about 7500 volts. In operation, as member 82 is electrically charged, the distal tip 84 becomes positively charged. As droplet 88 travels up to target medium 78, it becomes subjected to a high voltage static field and becomes polarized, as shown by the positive (+) and negative (−) charge on droplet 88. The charge on distal tip 84 and on droplet 88 produces a dipole moment which acts to further influence the trajectory of droplet 88 to travel towards the position of tip 84. Thus, positioning of distal tip 84 at a desired location above target 78 allows for even more accuracy in depositing droplet 88 in the desired position on target 78 to within 10–50 μm. Droplet 88 behaves as a dipole moving through an electric field in relation to distal tip 84 which preferably acts as a point charge. The electrostatic force on droplet 88 may be calculated by the following equation (1):

$$F = x \cdot p \cdot \nabla E \tag{1}$$

where,

F=force acting on droplet 88;

x=droplet 88 position in relation to tip 84;

p=dipole moment;

∇E=divergence of the electric field at point of droplet 88.

The force, F, acting on droplet 88 by electrically chargeable member 82 is proportional to the dipole moment, p, which does not change significantly with the size of droplet 88. Thus, the ability to influence the trajectory of droplet 88 with electrically chargeable member 82 generally increases as the size or volume of droplet 88 decreases because the momentum of droplet 88 decreases as its size decreases for a given droplet velocity.

Figure 8A:
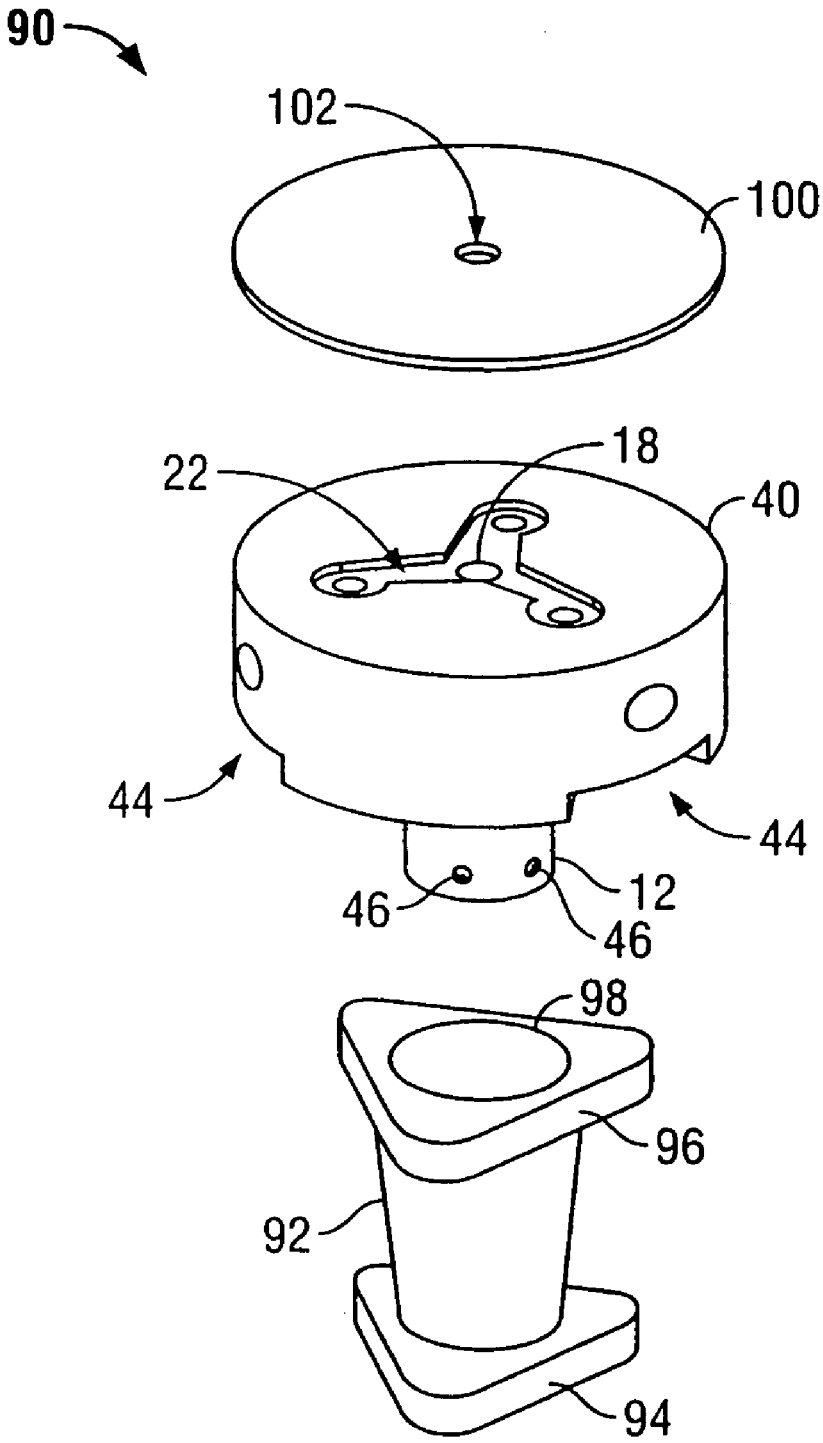
FIG. 8A shows an exploded isometric view of another droplet steering assembly having a top plate and a well insert or capillary tube.

To further aid in generating an accurate trajectory of a droplet ejected from a pool of source fluid, FIG. 8A shows an exploded isometric view of alternative droplet steering assembly 90 having top plate 100, which may be used to seal fluid flow channels 22, and well insert or capillary tube 92 which may be used with main body 40. Examples of the use and design of capillary tubes are described in further detail in co-pending U.S. patent application entitled "Apparatus And Method For Controlling The Free Surface Of Liquid In A Well Plate" filed on Nov. 5, 2001. Top plate 100 is preferably used to seal channels 22 and to prevent the fluid flow from interfering with accurate droplet deposition while still allowing droplets to pass therethrough via orifice 102.

Figure 8B:
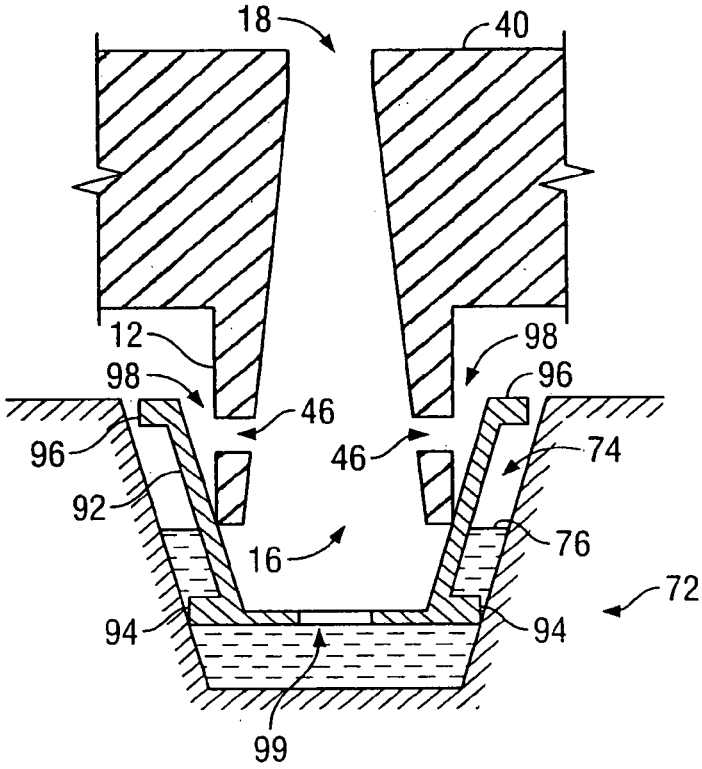
FIG. 8B shows a cross-sectional partially assembled representation of FIG. 8A.

As further seen in FIG. 8A, a proximal end of nozzle 12 may be inserted into channel 98 of capillary tube 92, as also seen in FIG. 8B which is a cross-sectional partially assembled representation of FIG. 8A. Capillary tube 92 may be used as a meniscus control device by placing the lower portion or lower support tabs 94 into well 74 such that lower tabs 94 and orifice 99 are preferably immersed in source fluid 76. Capillary tube 92 may be aligned within well 74 by lower support tabs 94 and upper support tabs 96. As seen, channel 98 may mate with nozzle 12 such that nozzle 12 is securely fitted within channel 98. Fluid inlets 46, as defined along nozzle 12 near the proximal end, preferably remain unobstructed by capillary tube 92 to ensure the free flow of fluid within main body 40. Capillary tube 92 preferably has orifice 99 defined within a bottom surface of tube 92 to maintain a controlled meniscus and to reduce any perturbations within the fluid surface during droplet ejection.

Figure 10:
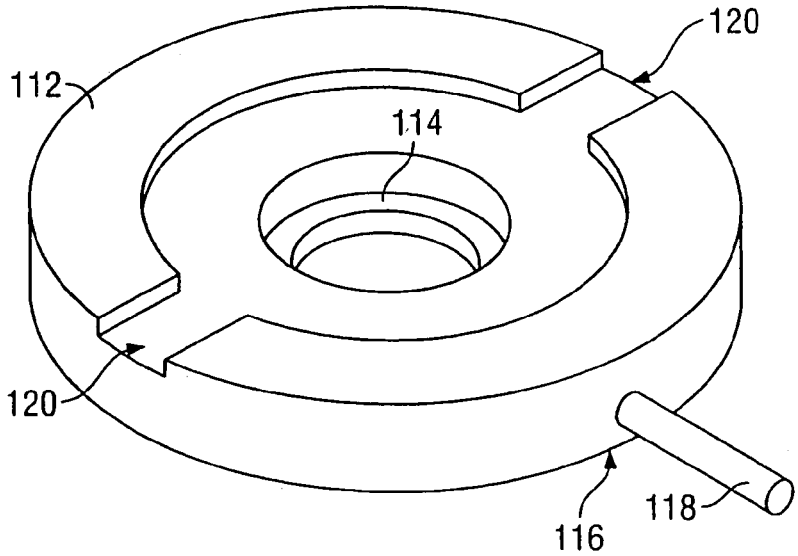
FIG. 10 shows an isometric view of the underside of the manifold of FIG. 9.
Figure 9:
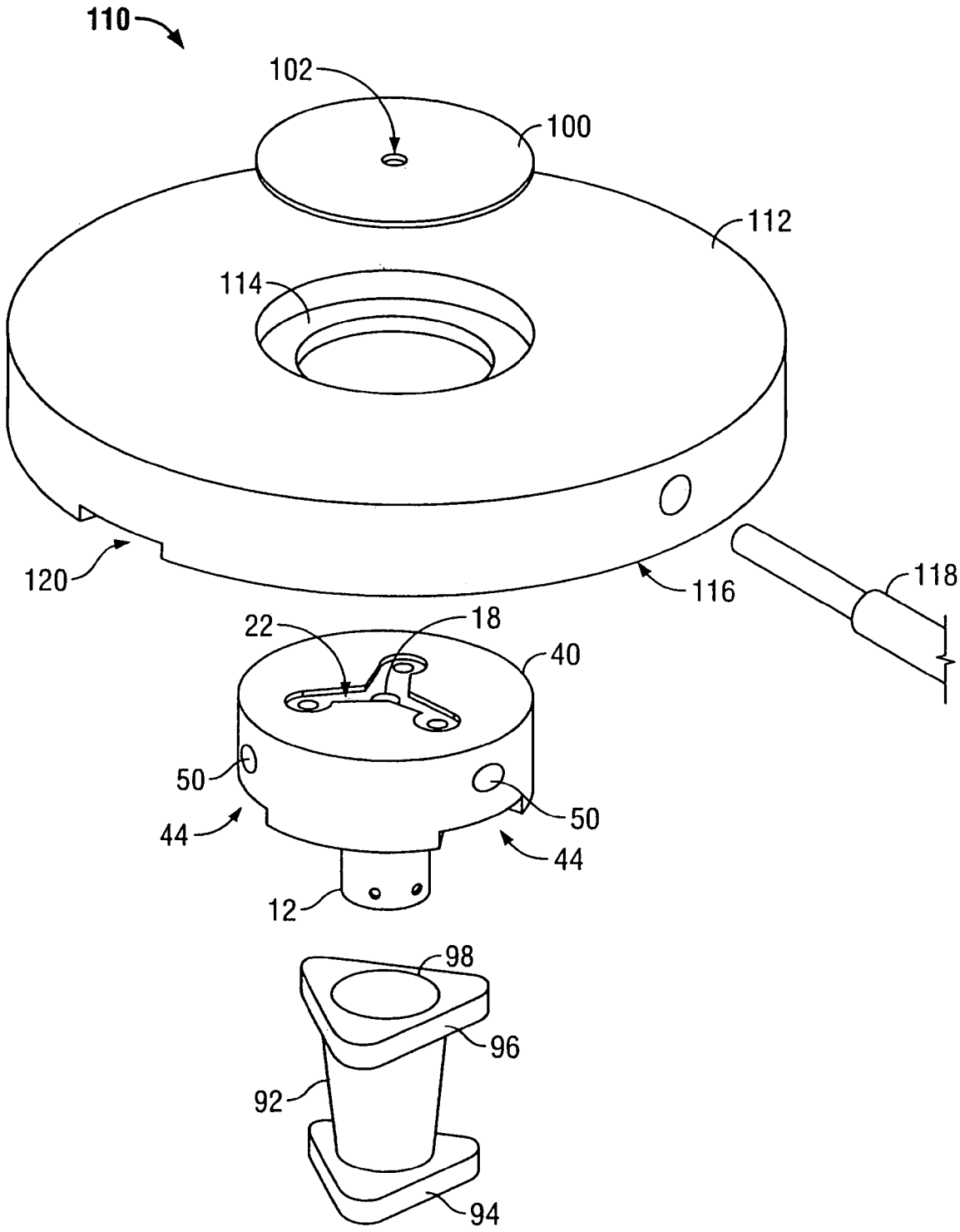
FIG. 9 shows an exploded isometric view of another variation on droplet steering assembly with a manifold which may be adapted to fit over the main body.

In addition to capillary tube 92, further modifications may be made to facilitate the droplet steering. A further variation on droplet steering assembly 110 is seen in the exploded isometric view of FIG. 9. In this variation, manifold 112 may be adapted to fit over main body 40 such that they are in fluid communication with one another. Main body 40 may fit into manifold 112 via receiving channel 114, over which top plate 102 may be placed to seal the fluid flow. FIG. 10 shows an isometric view of the underside of manifold 112. As seen in FIG. 9, manifold 112 may fit over and around main body 40 such that channel 114 is fluidly coupled to fluid outlets 50 of main body 40. Receiving channel 114 preferably forms a single passageway from the different outlets 50 to facilitate the assembly and construction of assembly 110. The collective fluid flow exiting outlets 50 may be drawn through a common orifice 116 to which attachment tube 118 may be connected leading to, e.g., a vacuum pump. When main body 40 and manifold 112 are assembled, the bottom surface of manifold 112, where channels 120 are defined, preferably aligns with channels 44 defined in main body 40 to ensure a free passageway for the fluid to flow to main body 40.

Figure 11A:
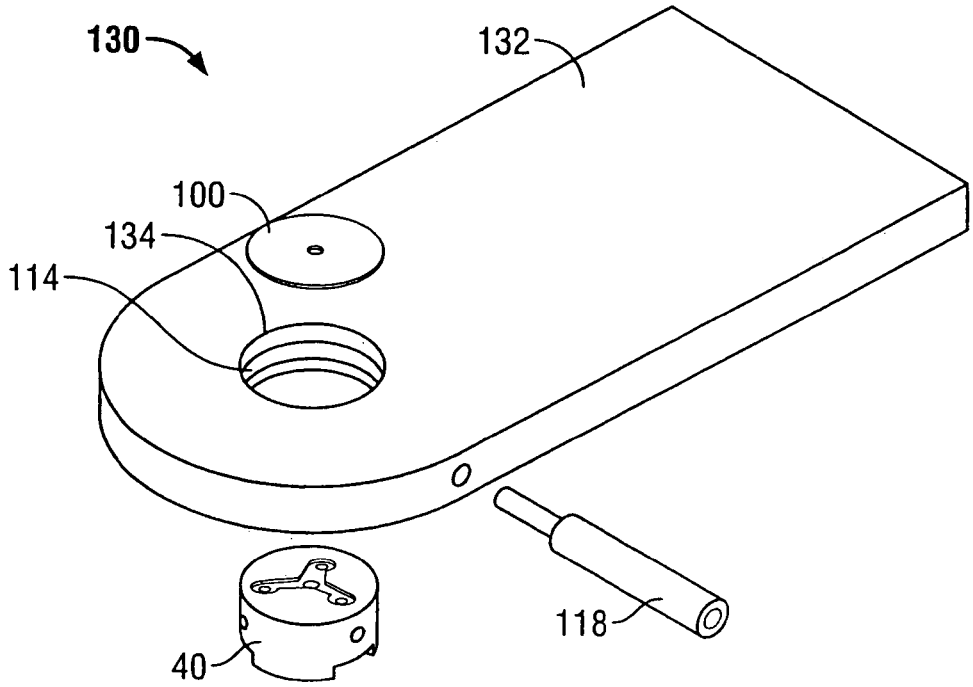
FIGS. 11A and 11B show exploded top and bottom isometric views, respectively, of an alternative manifold design.
Figure 11B:
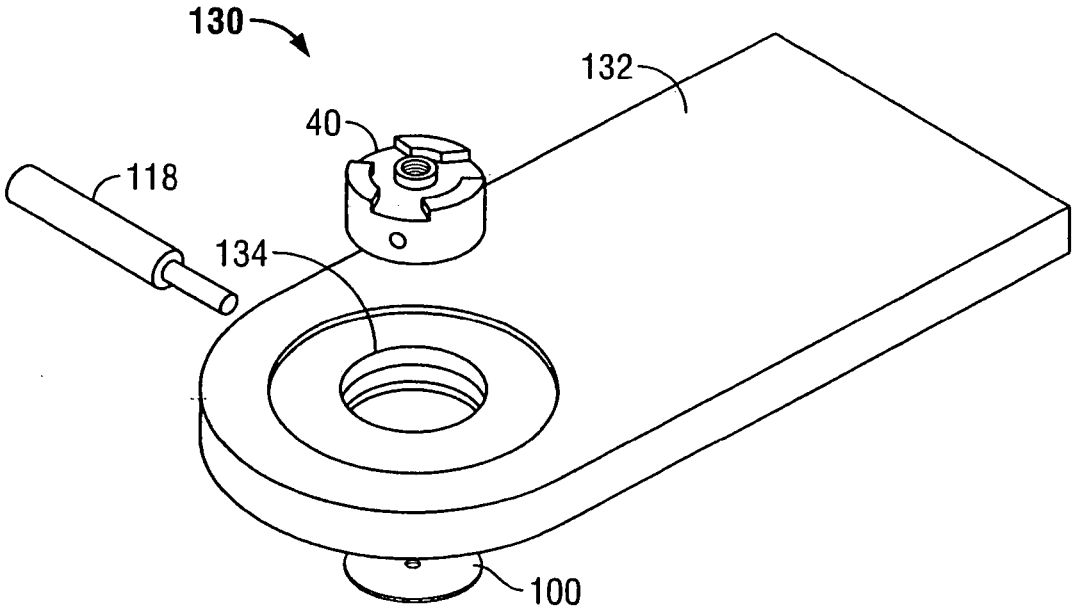

An alternative manifold design is shown in the exploded top and bottom isometric views of droplet steering assembly 130 of FIGS. 11A and 11B, respectively. FIGS. 11A and 11B show support manifold 132, which preferably operates in much the same manner as described above, having an extending support arm or member. Near a distal end of support manifold 132, main body 40 may fit within receiving channel 134 and become sealed with top plate 100. The extending support manifold 132 may allow for application of assembly 130 in multi-well platforms as well as allowing for greater flexibility in the placement and size of targets.

Figure 12A:
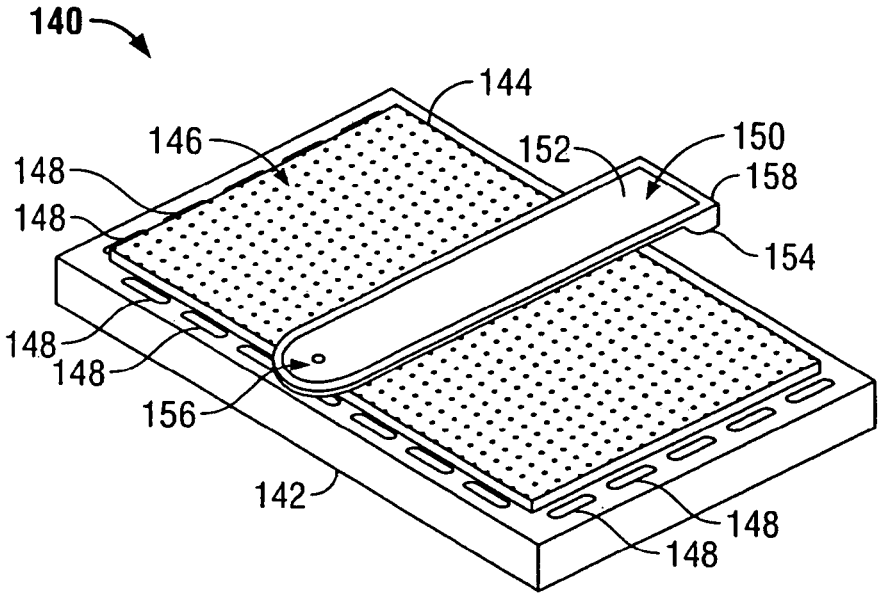
FIGS. 12A and 12B show isometric assembly and exploded assembly views, respectively, of an attachable wellplate lid assembly.
Figure 12B:
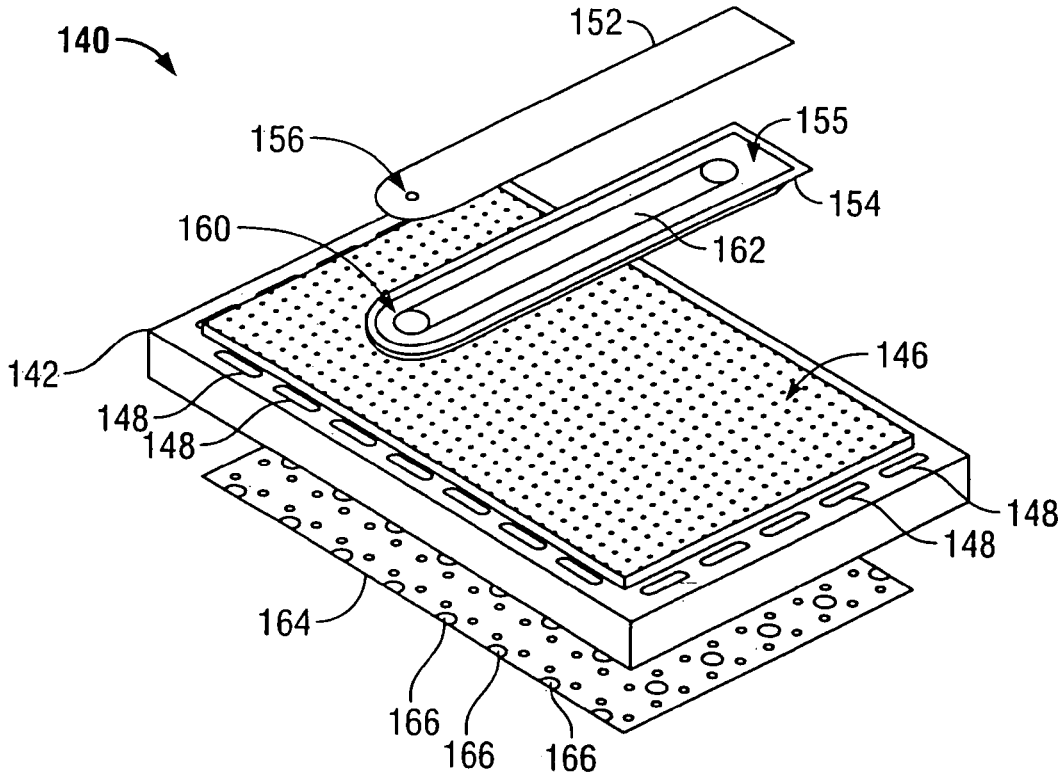

A further variation on the droplet steering assembly is shown in FIGS. 12A and 12B. FIG. 12A illustrates an isometric assembly view of a fluid transfer system 140 with a separately attachable lid assembly 142 and FIG. 12B illustrates the exploded isometric assembly view of the system of FIG. 12A. In this variation, rather than utilizing a single nozzle or throat positioned over a number of different wells of a wellplate, lid assembly 142 comprises a plate which may be placed over a conventional wellplate and which defines any number of nozzles within the plate preferably corresponding to the number of wells within the wellplate. For instance, a conventional wellplate, e.g., a microtiter plate, having 24, 96, 384, 1536 3456, or 6912 wells may have a lid assembly with a corresponding number of nozzles or throats. A fluid source assembly 150 may be placed over lid assembly 142 and is positionable over the droplet outlet array 144, which comprises the array of orifices or droplet outlets 146 arranged over lid assembly 142 for alignment with the individual wells defined in a wellplate over which lid 142 may be positioned. Lid 142 may have a number of fluid stream inlets 148 located about the periphery of array 144 which are preferably in fluid communication through a common plenum with each of droplet outlets 146.

The fluid source assembly 150 is preferably affixed at one end 158 and is located above droplet array 144. Fluid source assembly 150 may comprise manifold 154, shown as an elongate apparatus but which may be made of any amenable shape. Within manifold 154 is channel 155 which preferably extends throughout manifold 154 and may be sealed by top plate 152. At the opposite end of assembly 150, receiving channel 160 may be defined within manifold 154 for drawing the fluid therethrough which may be used to steer the droplet and droplet orifice 156 may be defined in top plate 152 and aligned with channel 160 for allowing the droplet to pass through towards the targeting medium. Channel 155 is defined such that it is preferably perpendicularly positioned relative to a centerline defined by droplet orifice 156. Fluid flow lines 162 are shown in FIG. 12B and depict the fluid flow through receiving channel 160 and through manifold 154. A detailed explanation of the apparatus in operation will be discussed below.

Figure 13:
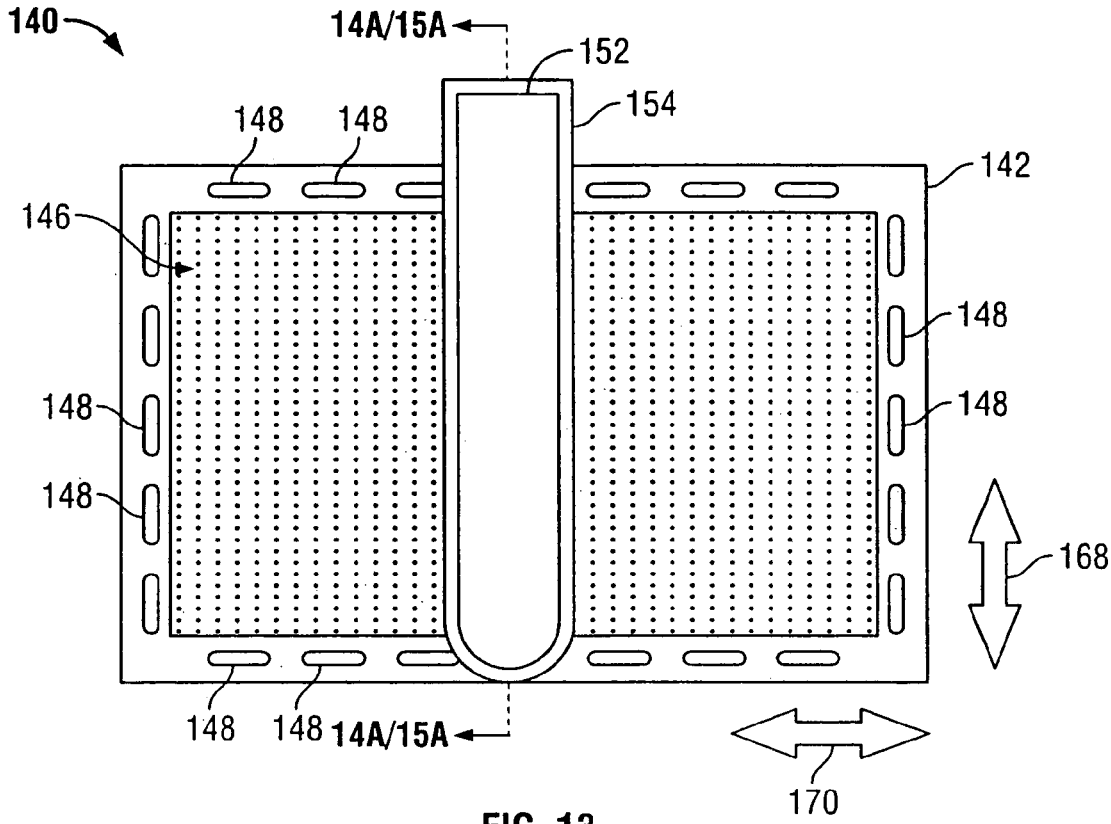
FIG. 13 shows a top view of the assembly of FIG. 12A.

System 140 may also have an optional well mask 164 disposed within lid assembly 142, as seen in the exploded view of FIG. 12B. Mask 164 may be comprised of a plate having any number of orifices 166 which are preferably aligned with and correspond to droplet outlets 146 defined in droplet array 144. Well mask 164 may be utilized to lay upon the wellplate over which lid assembly 140 is placed and it may also be used to help define the plenum through which the fluid may flow, as discussed below. FIG. 13 shows a top view of the system 140 as seen in FIG. 12A. Lid assembly 142 may be positioned below manifold 154 with enough space to provide adequate clearance when assembly 142 is translated relative to manifold 154. However, assembly 142 is closely spaced enough from assembly 142 such that the fluid flowing through the system for correcting droplet trajectories retains sufficient pressure. Assembly 142 may be translated in both y- and x-directions, as depicted by arrows 168 and 170, relatively, and as viewed in FIG. 13 to align the preselected wells in the wellplate beneath while maintaining manifold 154 and the position of droplet orifice 156 stationary.

Figure 14A:
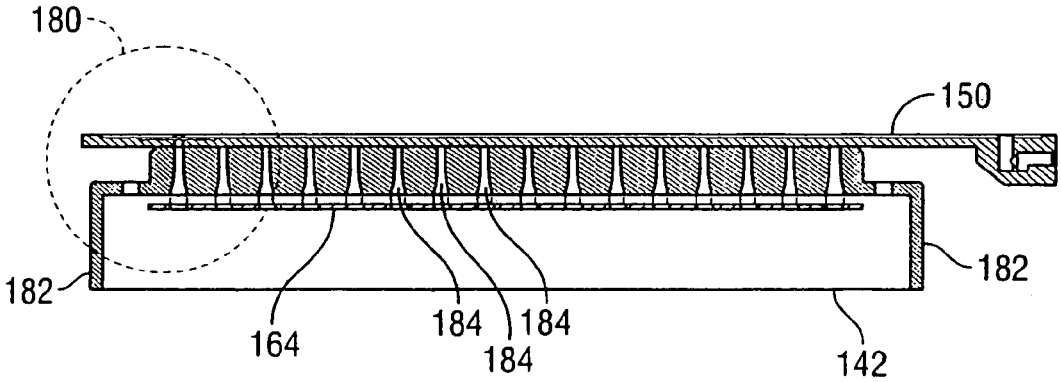
FIG. 14A shows cross-section 14A—14A from FIG. 13 of the manifold and lid assembly.
Figure 14B:
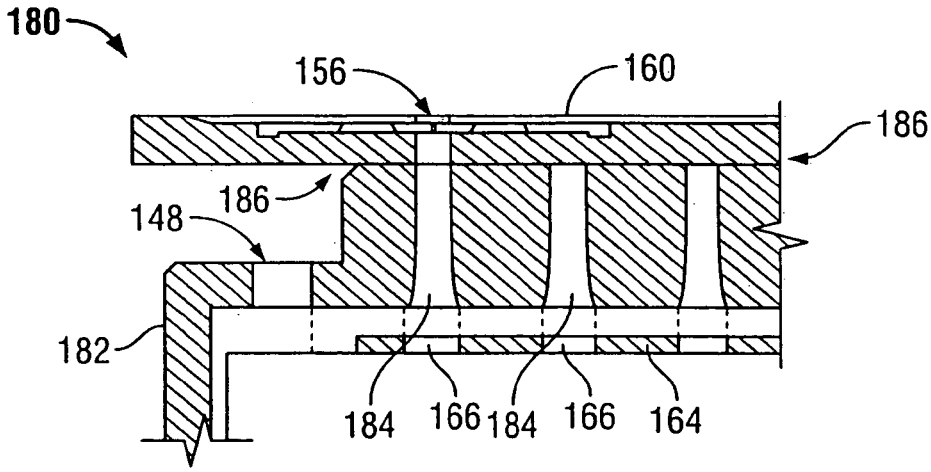
FIG. 14B shows a detailed view of the cross-section from FIG. 14A.

FIG. 14A shows cross-section 14A—14A from FIG. 13 of lid assembly 142 positioned in relation to fluid source assembly 150. A gap 186 preferably exists between the top of lid assembly 182 and fluid source assembly 150 to allow for the free translation of lid 182 relative to source assembly 150. As illustrated, lid 142 may comprise a plurality of nozzles or throats 184 preferably defined integrally within the lid 142. The inlets of each throat 184 are defined in the lower or first surface which faces the wellplate (shown in FIG. 15A) while the throat 184 outlets are defined in the upper or second surface of assembly 142 through which the droplets pass through. Each throat 184 is preferably formed with elliptically-shaped walls, as described above, and lid 142 is preferably formed with enclosing walls 182 surrounding well mask 164, which is preferably positioned proximally adjacent to throats 184. Lid assembly 142 is formed with an open bottom defined by enclosing walls 182, as shown, to allow for placement over a wellplate. FIG. 14B shows lid detail 180 from FIG. 14A. The left-most throat 184 may be seen aligned with droplet orifice 156 of assembly 150 and receiving channel 160 is also shown formed into assembly 150 for receiving the fluid flow which may enter the lid assembly through fluid stream inlet 148 which is preferably defined within wall 182.

Figure 15A:
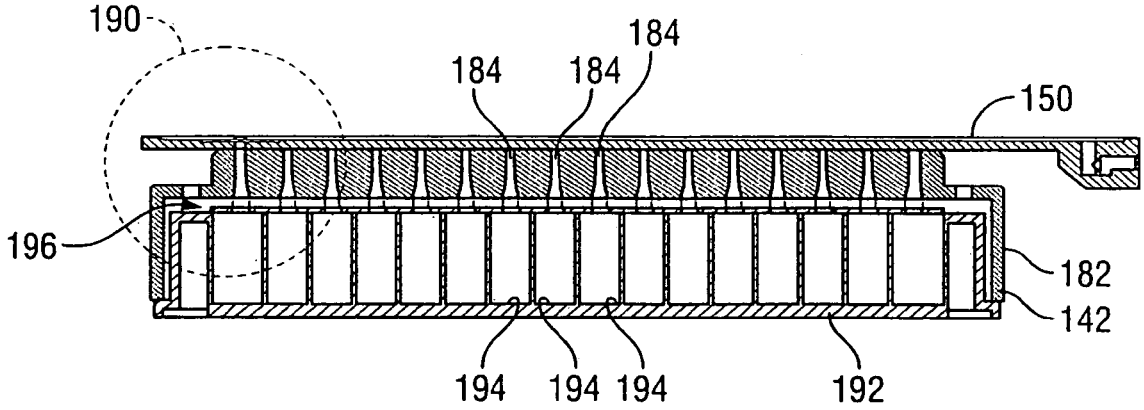
FIG. 15A shows cross-section 15A—15A from FIG. 13 of the manifold and lid assembly placed over a wellplate.
Figure 15B:
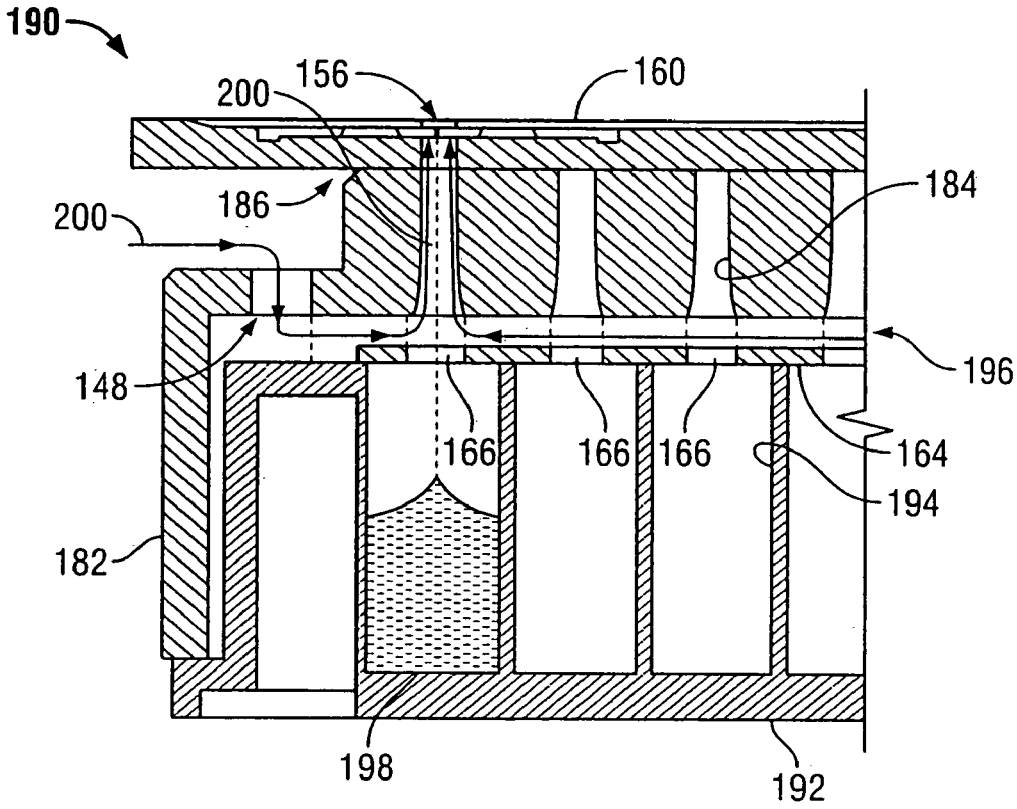
FIG. 15B shows a detailed view of the cross-section from FIG. 15A.

FIG. 15A shows cross-section 15A—15A from FIG. 13 of fluid source assembly 150 also positioned relative to lid assembly 142 over wellplate 192. Individual wells 194 within wellplate 192 preferably align with orifices 166 within well mask 164 and throats 184. Flow channel 196 is preferably defined in part between the lower or first surface of lid 142 and well mask 164, as seen clearly in detail 190 of FIG. 15B taken from FIG. 15A. As fluid, represented by fluid flow lines 200, is drawn through fluid stream inlet 148 by, e.g., a vacuum in fluid communication with fluid source assembly 150, the fluid flows through flow channel 196 to the appropriate throat 184 through which the fluid is drawn through. The fluid flow 200 is then drawn through the throat and may pass the upper or second surface of lid 142, through gap 186 defined between lid 142 and assembly 150, and then into fluid source assembly 150 where it is then preferably drawn through receiving channel 160 away from droplet orifice 156. Fluid flow 200 is preferably drawn perpendicularly away from the centerline defined by throat 184 in much the same manner as described above.

Figure 16:
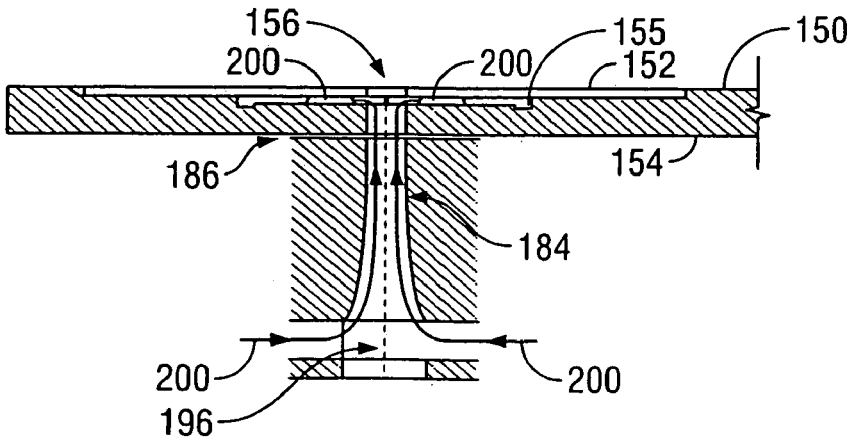
FIG. 16 shows a cross-sectional detailed view of a nozzle within a lid assembly in operation with the manifold.

As fluid flow 200 is drawn through flow channel 196 and throat 184, a droplet may be ejected from droplet reservoir 198, as shown. As it is ejected, the droplet may then pass through orifice 166 defined within well mask 164 and then passes through throat 184 and exits through droplet orifice 156 in much the same manner as again described above. FIG. 16 shows a closer detailed view of a cross-sectioned throat 184 and fluid source assembly 150 with fluid flow lines 200. Once fluid flow 200 is drawn past gap 186 and into channel 155 defined within manifold 154, it is contained in part by top plate 152. Plate 152 allows the fluid 200 to be contained therewithin to aid in maintaining the pressure as well as allowing the droplet to pass through droplet orifice 156. The use of such a lid assembly 142 over wellplate 192 may help to maintain source fluid integrity, i.e., aids in preventing cross-contamination of liquids from well to well, and also helps to reduce exposure of the fluids within the wells from the environment.

Figure 17:
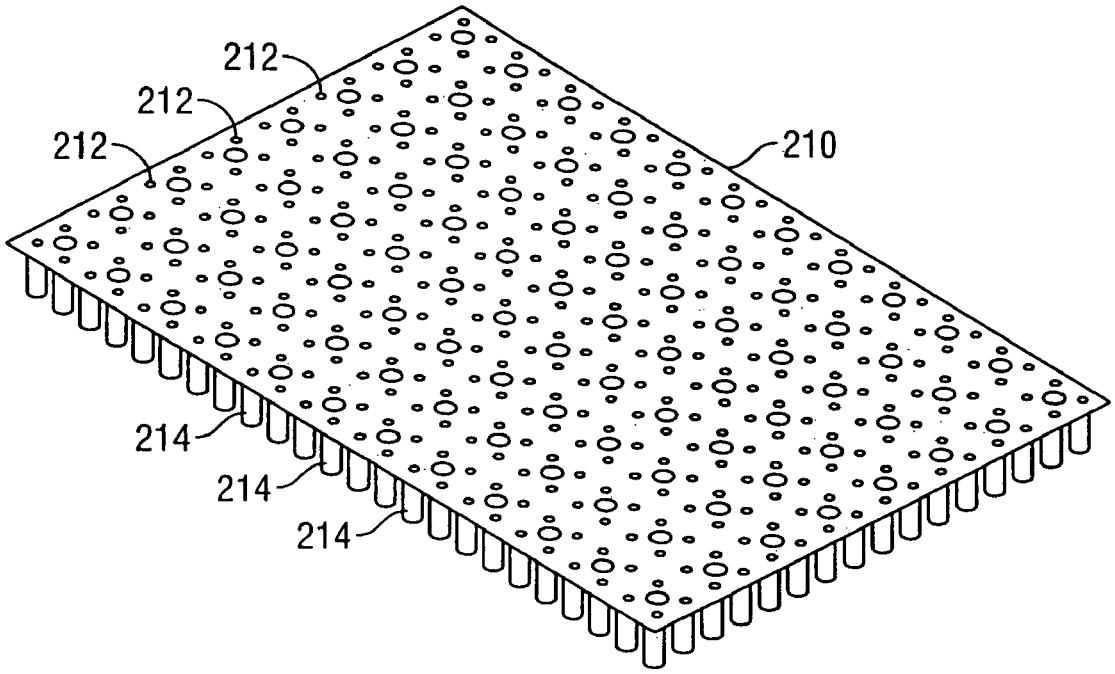
FIG. 17 shows an isometric view of an alternative well mask having multiple capillary tubes.
Figure 18A:
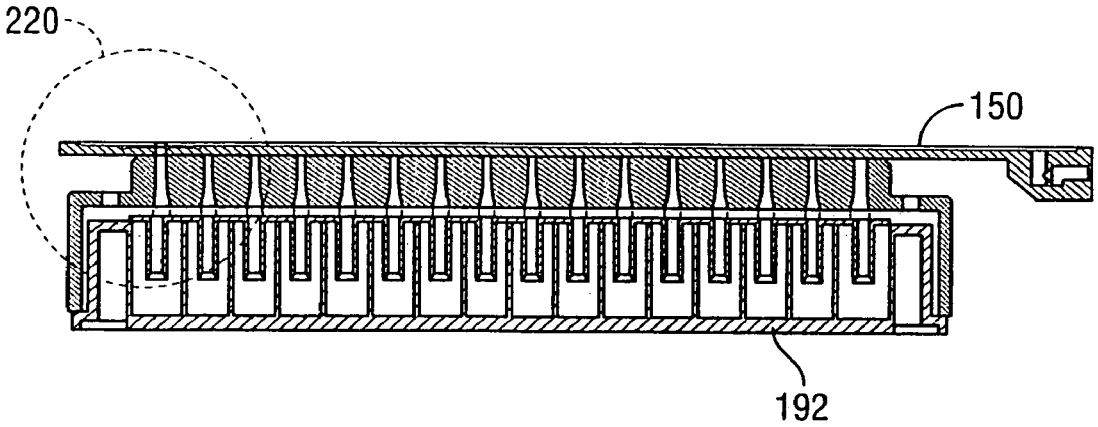
FIG. 18A shows a cross-sectional view of the manifold and lid assembly with the capillary tubes within wells.
Figure 18B:
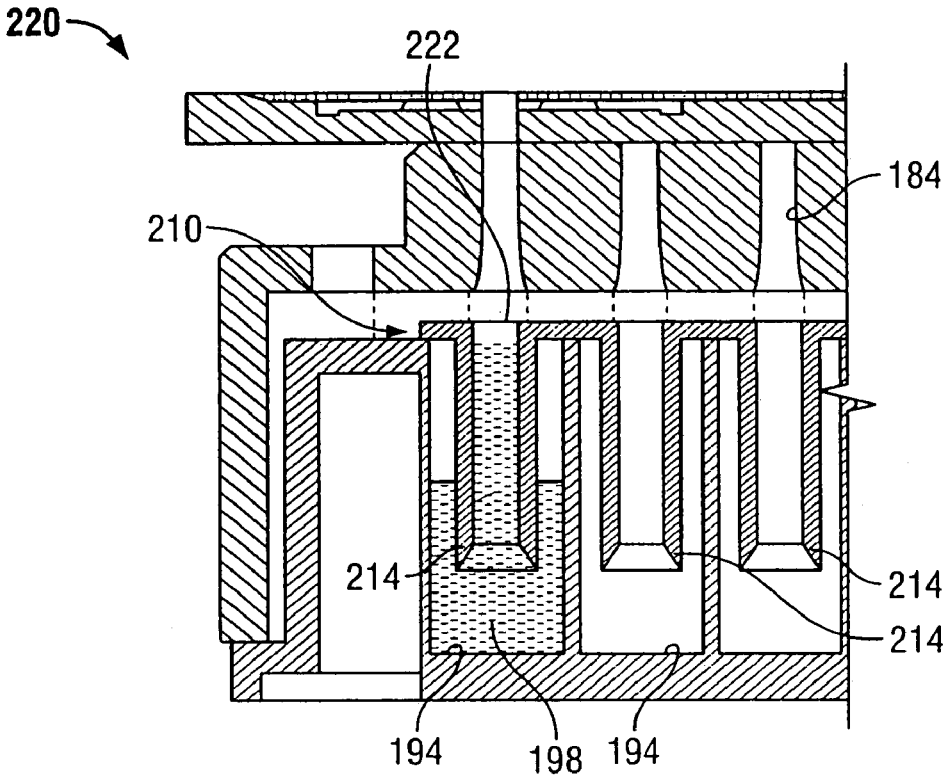
FIG. 18B shows a detailed view of the cross-section from FIG. 18A.

A further optional variation of lid assembly 142 may include a variation on the well mask contained therewithin. As seen in FIG. 17, capillary well mask 210 shows one variation of a well mask plate having a number of capillary tubes or well inserts 214 attached thereto with orifices 212 defined within each capillary tube 214. Capillary tubes 214 may be formed on well mask 210 such that they are individually formed and capable of being inserted individually within a number of corresponding wells within a wellplate, e.g., wellplate 192, as seen in FIG. 18A. FIG. 18B shows a detail view 220 from FIG. 18A of capillary well mask 210 placed over wellplate 192 with individual capillary tubes 214 inserted into individual wells 194. Droplet reservoir 198 is shown partially filled within well 194 with capillary tube 214 positioned within. After tube 214 has been placed within the liquid 198, liquid 198 will tend to be pulled into tube 214 and drawn up through orifice 212 by capillary action to a liquid level 222, which is above the level of fluid contained within well 194. Having capillary tube 214 inserted within each well 194 may help to maintain a relatively constant liquid level 222 from well to well. This in turn helps to maintain a constant focal point across each of the wells 194 for a droplet generator to focus the energy required to eject the droplet and ultimately reduces the time spent focusing and refocusing the energy in different wells having different liquid levels.

Figure 19A:
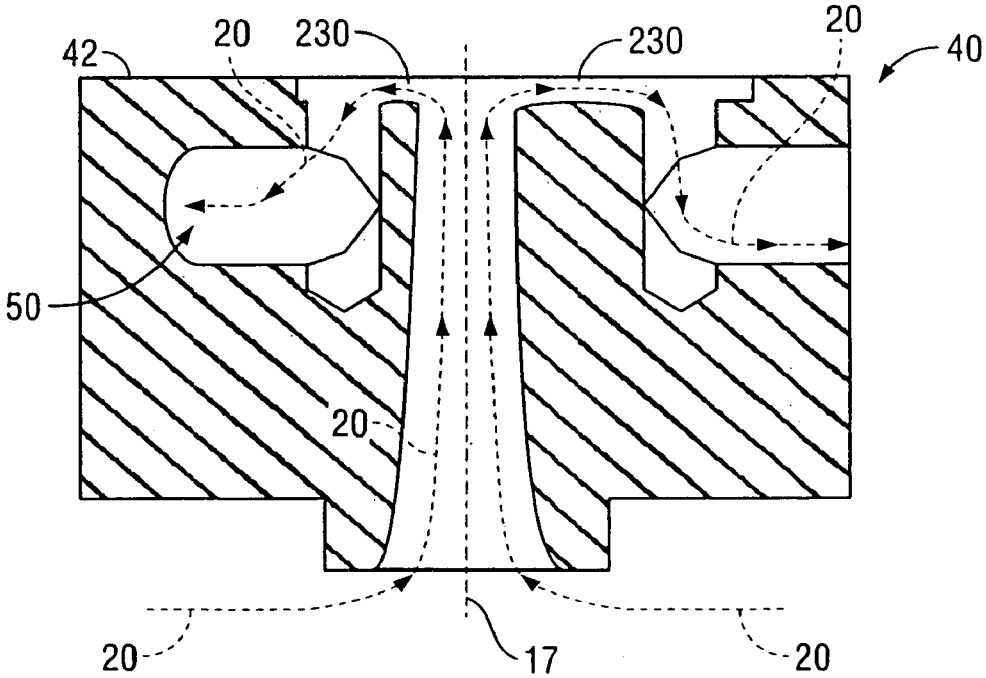
FIG. 19A shows a variation of the main body from FIG. 6 with elliptically-shaped fluid flow paths.
Figure 19B:
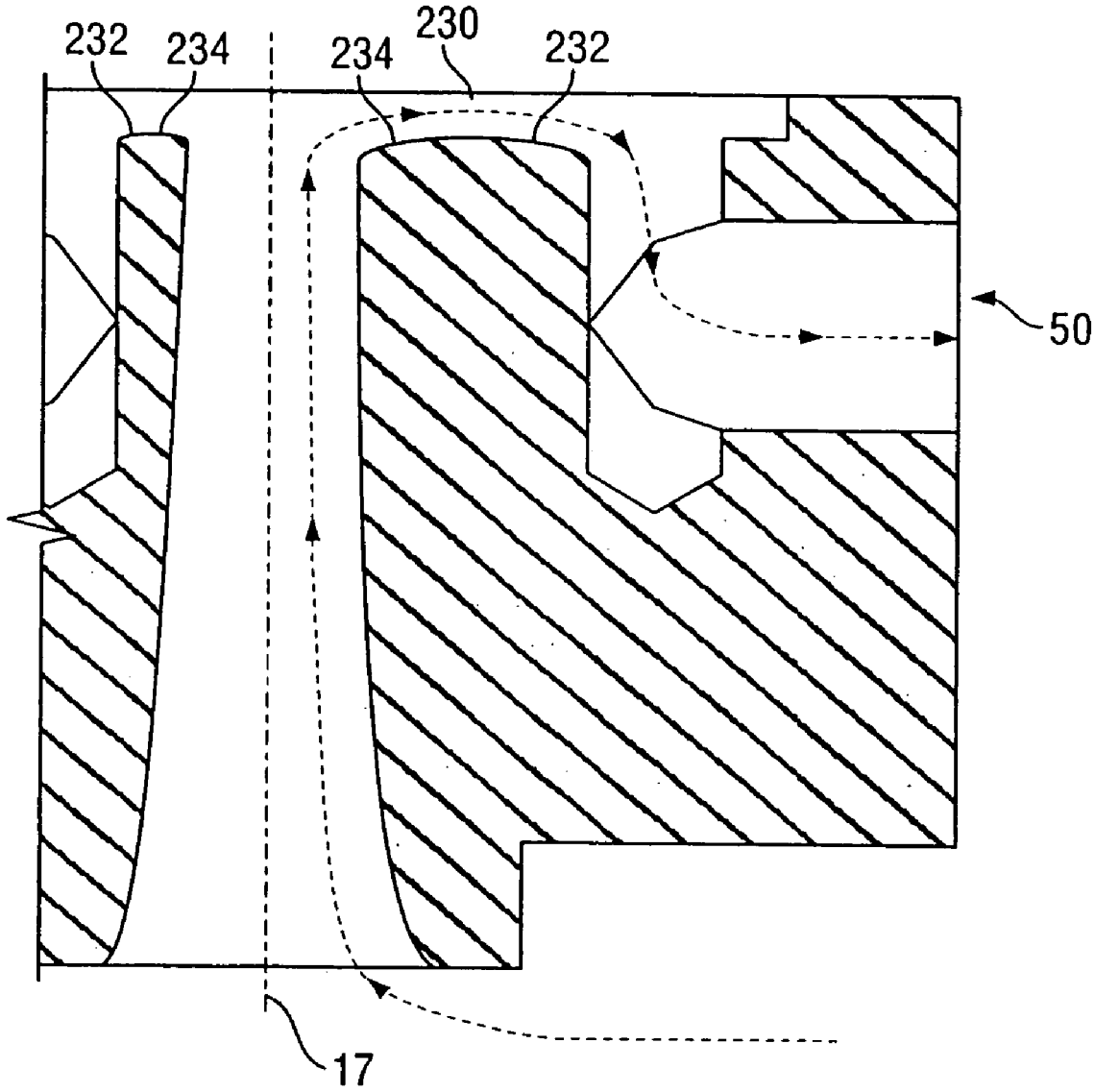
FIG. 19B shows a detailed view of the fluid flow path from FIG. 19A.

Yet another variation is seen in FIGS. 19A and 19B, which are cross-sectional views of main body 40. Main body 40 is similar to that shown in FIG. 6 and described above, but this variation includes elliptically shaped exit channels 230 defined in part by elliptical paths 232. Elliptical paths 232, as seen in the detailed view in FIG. 19B, are defined by a wall having a cross-sectional profile which partially follows an elliptical shape. A major axis of the elliptical profile is preferably perpendicular to centerline 17. This allows the fluid to enter the inlet of main body 40, travel through the throat and then be drawn abruptly away from centerline 17 through elliptical exit channel 230 while maintaining a smooth transition for the exit flow as well as maintaining an equal exit flow on the throat diameter. The use of elliptical path 232 may also aid in preventing boundary layer separation of the flow at separation region 234 when traveling through channel 230. Boundary layer separation may present an instability in the flow of the fluid and ultimately in the performance of the system in efficiently ejecting droplets.

Figure 20A:
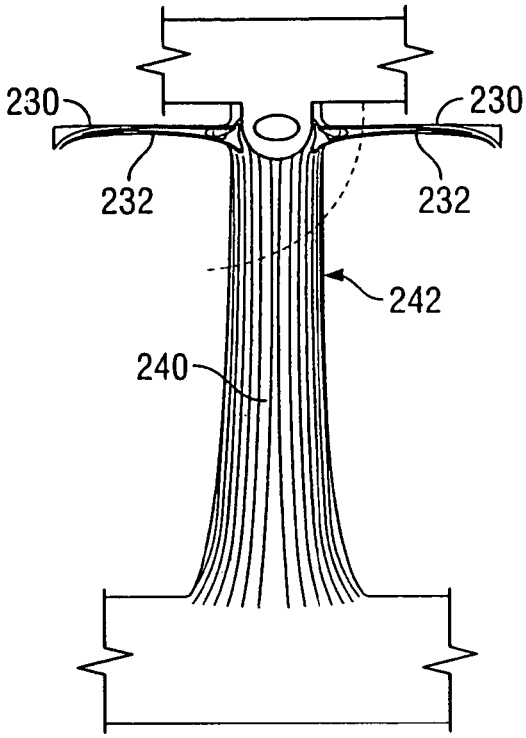
FIGS. 20A and 20B shows an example of the flow of the fluid passing through the elliptically-shaped paths.
Figure 20B:
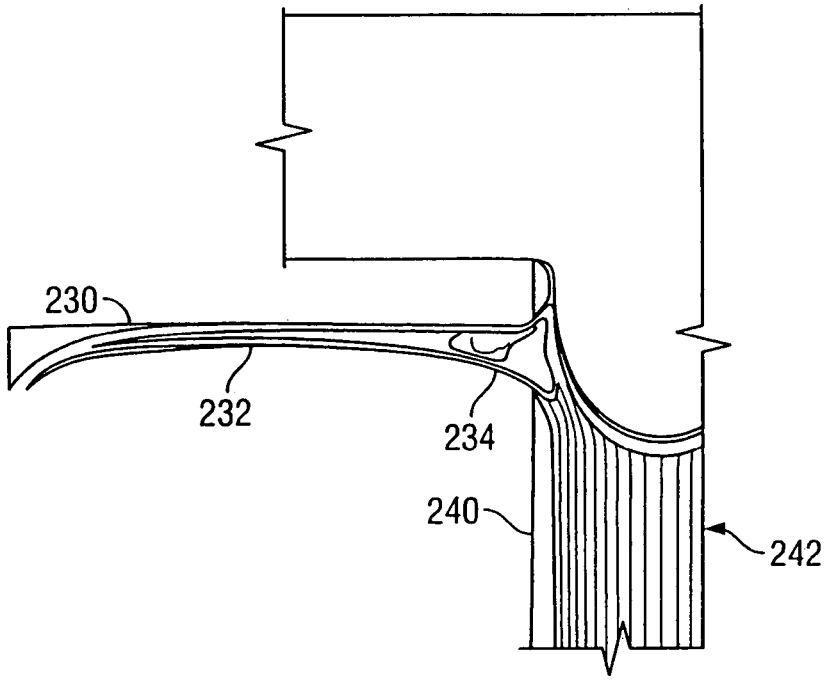

FIGS. 20A and 20B show a schematic view of an example of the fluid flow through throat 240 to illustrate the effect of elliptical paths 232. The fluid flow, as represented by flow lines 242, is shown passing through throat 240 parallel to a centerline of throat 240 until they approach elliptical exit channel 230. As seen in FIG. 20B, which is a detailed view of the transitioning flow from FIG. 20A, flow lines 242 transition smoothly along elliptical path 232 through exit channel 230. The smooth flow is indicative of the minimal effects to the flow velocity and the absence of boundary layer separation at separation region 234 further indicates that the flow is relatively stable.

Figure 21:
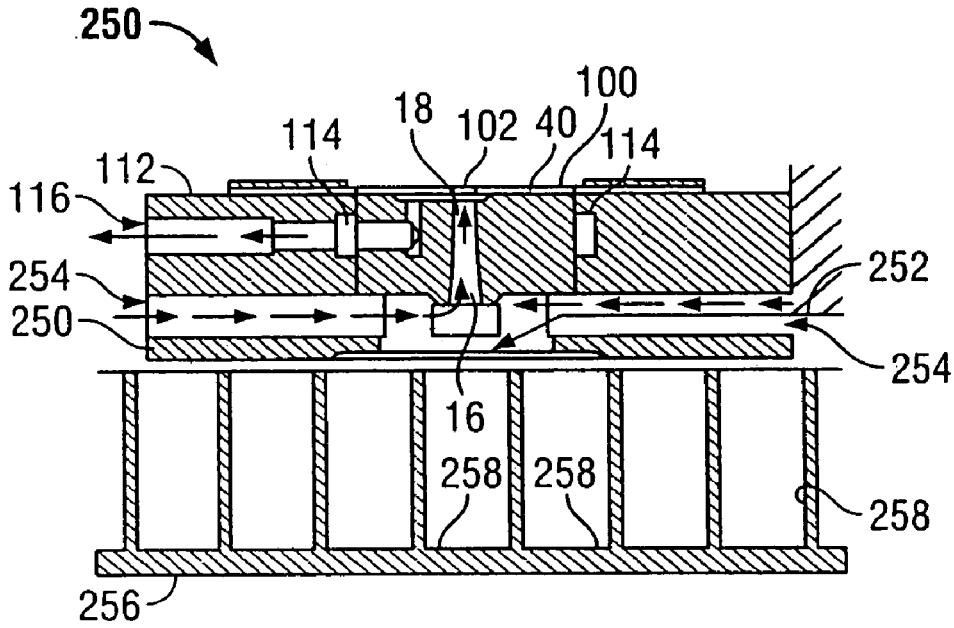
FIG. 21 shows a cross-sectional view of a droplet steering assembly with a well mask having a modified diameter for use with relatively large wells.

A further variation of the well mask which may be used with large diameter wells is shown in FIG. 21, which is a cross-sectioned assembly view 250. Wellplate 256 in this variation has enlarged diameter wells 258, i.e., diameters measuring 4.5 mm or greater. When fluid flows over large wells 258 within flow channel 254 towards inlet 16, eddy currents may form in large diameter wells 258 and this may have an effect on the ejected droplet alignment. To emulate a conventionally sized well while retaining the increased volume capacity of a large diameter well, a well mask having a sized diameter 252 may be implemented by placing well mask orifice 252 over the top of large well 258.

Figure 22A:
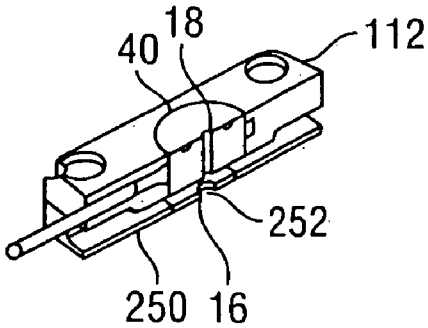
FIGS. 22A and 22B show isometric cross-sectional top and bottom views, respectively, of the assembly from FIG. 21.
Figure 22B:
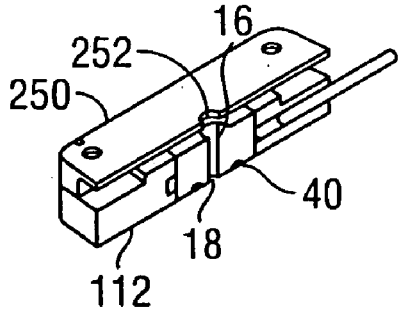

FIGS. 22A and 22B show a top and bottom isometric cross-sectioned view, respectively, of the variation 250 shown in FIG. 21. This variation may be used as a well mask 252 with main body 40 and manifold 112 and may be independently translated over well plate 256 from well to well as opposed to variations described above which may remain stationary over each well 258. The diameter of well mask orifice 252 may be varied to match that of a conventional well diameter or it may be reduced further as long as the diameter is sufficiently large enough to give adequate clearance for a droplet to pass through intact.

The applications of the droplet steering assemblies discussed above are not limited to acoustically ejected droplets but may include any number of further droplet or discrete fluid volume applications. Modification of the above-described assemblies and methods for carrying out the invention, and variations of aspects of the invention that are obvious to those of skill in the art are intended to be within the scope of the claims.

We claim:

1. A device for altering a trajectory of a droplet comprising:

a nozzle for accepting a fluid stream and at least one droplet having a first trajectory, the nozzle being shaped so that the fluid stream alters the first trajectory, the nozzle comprising an entrance port at a proximal end of the nozzle, an exit port at a distal end of the nozzle and a throat through which the fluid stream and the droplet move, with the throat extending from the entrance port to the exit port, and the entrance port having a first cross-sectional diameter taken perpendicular to a centerline that is centered in the throat and that extends from the proximal end to the distal end, and the exit port having a second cross-sectional diameter taken perpendicular to the centerline that is less than the first cross-sectional diameter, and the throat having a throat cross-sectional diameter taken perpendicular to the centerline with the throat cross-sectional diameter changing over most of the distance from the entrance port to the exit port; and wherein the first trajectory of the droplet traversing the throat is alterable by the fluid stream in the throat to a second trajectory without breaking apart the droplet.

2. The device of claim 1 wherein the second trajectory is approximately coincident with the centerline at the exit port.

3. The device of claim 1 wherein the fluid stream comprises a gas.

4. The device of claim 3 wherein the gas comprises air.

5. The device of claim 1 wherein the fluid stream comprises a mist stream.

6. The device of claim 1 wherein the droplet has a diameter in the range of 5 to 300 microns.

7. The device of claim 1 wherein the fluid stream is drawn through the throat by a vacuum.

8. The device of claim 1 further comprising a fluid outlet positioned near the distal end of the nozzle for removing the fluid stream from the throat.

9. The device of claim 8 further comprising a vacuum pump in fluid communication with the fluid outlet.

10. The device of claim 1 wherein the fluid enters the throat through the entrance port.

11. The device of claim 1 wherein the fluid enters the throat through a channel defined distally of the proximal end.

12. The device of claim 1 wherein the throat is defined by a wall having a cross-sectional profile which partially follows an elliptical shape from the entrance port to the exit port wherein a major axis of the elliptical shape is parallel to the centerline.

13. The device of claim 1 wherein the first cross-sectional diameter is in the range of 1.0–3.0 mm.

14. The device of claim 1 wherein the second cross-sectional diameter is in the range of 0.025–1.0 mm.

15. The device of claim 1 wherein the first cross-sectional diameter is parallel to the second cross-sectional diameter.

16. A method of altering a trajectory of a droplet comprising:

flowing a fluid stream through a nozzle adapted for accepting at least one droplet, the nozzle comprising an entrance port at a proximal end of the nozzle, an exit port at a distal end of the nozzle and a throat through which the fluid stream and the droplet move, with the throat extending from the entrance port to the exit port, and the entrance port having a first cross-sectional diameter taken perpendicular to a centerline that is centered in the throat and that extends from the proximal end to the distal end, and the exit port having a second cross-sectional diameter taken perpendicular to the centerline that is less than the first cross-sectional diameter, and the throat having a throat cross-sectional diameter taken perpendicular to the centerline with the throat cross-sectional diameter changing over most of the distance from the entrance port to the exit port;

passing the droplet into the entrance port, the droplet having a first trajectory;

altering the first trajectory of the droplet to a second trajectory with the fluid stream; and passing the droplet having the second trajectory through the exit port.

17. The method of claim 16 wherein the droplet has a diameter in the range of 5 to 300 microns.

18. The method of claim 16 wherein flowing the fluid stream through the nozzle comprises pulling the fluid stream through the throat with a vacuum pump adapted to be in fluid communication with the nozzle.

19. The method of claim 16 wherein the first trajectory of the droplet defines an angle of 0°–22.5° from the centerline.

20. The method of claim 16 wherein the second trajectory of the droplet defines an angle of 0° from the centerline.

* * * * *